US007867682B2

(12) United States Patent
Nozaki et al.

(10) Patent No.: US 7,867,682 B2
(45) **Date of Patent: *Jan. 11, 2011**

(54) TONER FOR DEVELOPING ELECTROSTATIC IMAGE, AND DEVELOPER, TONER CONTAINER, IMAGE FORMING APPARATUS AND PROCESS CARTRIDGE USING THE TONER

(75) Inventors: Tsuyoshi Nozaki, Ikeda (JP); Chiyoshi Nozaki, Otsu (JP); Minoru Nakamura, Takarazuka (JP); Atsushi Yamamoto, Kawanishi (JP)

(73) Assignee: Ricoh Company Limited, Tokyo (JP)

( * ) Notice: Subject to any disclaimer, the term of this patent is extended or adjusted under 35 U.S.C. 154(b) by 899 days.

This patent is subject to a terminal disclaimer.

(21) Appl. No.: 11/685,313

(22) Filed: Mar. 13, 2007

(65) Prior Publication Data

US 2007/0218393 A1 Sep. 20, 2007

(30) Foreign Application Priority Data

Mar. 16, 2006 (JP) ..... 2006-071935

(51) Int. Cl.
*G03G 9/00* (2006.01)

(52) U.S. Cl. ..... 430/110.2; 430/109.3; 430/109.4; 430/137.11; 430/137.12; 399/252

(58) Field of Classification Search ..... 430/110.2, 430/109.3, 109.4, 137.11, 137.12
See application file for complete search history.

(56) References Cited

U.S. PATENT DOCUMENTS

| | | | | |
|---|---|---|---|---|
| 5,302,486 | A * | 4/1994 | Patel et al. | 430/137.12 |
| 7,550,242 | B2 * | 6/2009 | Nozaki et al. | 430/110.2 |
| 2005/0058927 | A1 * | 3/2005 | Mikuriya et al. | 430/110.2 |
| 2006/0166122 | A1 * | 7/2006 | Patel et al. | 430/110.2 |
| 2006/0204882 | A1 | 9/2006 | Nozaki et al. | |
| 2006/0210902 | A1 | 9/2006 | Nakamura et al. | |
| 2006/0275686 | A1 | 12/2006 | Kadota et al. | |
| 2007/0184370 | A1 | 8/2007 | Yamashita et al. | |

FOREIGN PATENT DOCUMENTS

| | | |
|---|---|---|
| JP | 5-100480 | 4/1993 |
| JP | 5-158285 | 6/1993 |

(Continued)

OTHER PUBLICATIONS

U.S. Appl. No. 11/857,175, filed Sep. 18, 2007, Matsumoto, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

A toner including a core including at least a colorant, a release agent and a first binder resin; and a shell located overlying the core and including at least a second binder resin, wherein the first binder resin includes a polyester resin including a unit obtained from a diol selected from the group consisting of aliphatic diols and alicyclic diols, and the second binder resin includes a vinyl copolymer, and wherein a weight ratio (S/C) of the shell (S) to the core (C) is from 0.05 to 0.5 and the toner has a volume average particle diameter of from 3 to 8 μm.

19 Claims, 2 Drawing Sheets

FOREIGN PATENT DOCUMENTS

| | | |
|---|---|---|
| JP | 8-36274 | 2/1996 |
| JP | 2704282 | 10/1997 |
| JP | 3128907 | 11/2000 |
| JP | 2002-55483 | 2/2002 |
| JP | 2002-91082 | 3/2002 |
| JP | 2003-177568 | 6/2003 |
| JP | 2004-271919 | 9/2004 |
| JP | 2005-10208 | 1/2005 |
| JP | 2005-077603 | 3/2005 |
| JP | 2005-234410 | 9/2005 |
| JP | 2005-266565 | 9/2005 |
| JP | 2005-274964 | 10/2005 |

OTHER PUBLICATIONS

U.S. Appl. No. 12/017,853, filed Jan. 22, 2008, Masumoto, et al.
U.S. Appl. No. 12/026,057, filed Feb. 5, 2008, Nozaki, et al.
U.S. Appl. No. 12/035,892, filed Feb. 22, 2008, Kadota, et al.
U.S. Appl. No. 12/046,784, filed Mar. 12, 2008, Nozaki, et al.
U.S. Appl. No. 12/046,866, filed Mar. 12, 2008, Matsumoto, et al.
U.S. Appl. No. 12/048,689, filed Mar. 14, 2008, Kadota, et al.
U.S. Appl. No. 12/049,719, filed Mar. 17, 2008, Yamamoto, et al.
U.S. Appl. No. 12/050,663, filed Mar. 18, 2008, Izutani, et al.
U.S. Appl. No. 12/050,963, filed Mar. 19, 2008, Ishikawa, et al.
U.S. Appl. No. 12/043,633, filed Mar. 6, 2008, Nakamura, et al.
U.S. Appl. No. 12/046,869, filed Mar. 12, 2008, Nozaki, et al.
U.S. Appl. No. 12/172,378, filed Jul. 14, 2008, Yamamoto, et al.
U.S. Appl. No. 11/854,783, filed Sep. 13, 2007, Nakamura, et al.

* cited by examiner

TONER FOR DEVELOPING ELECTROSTATIC IMAGE, AND DEVELOPER, TONER CONTAINER, IMAGE FORMING APPARATUS AND PROCESS CARTRIDGE USING THE TONER

BACKGROUND OF THE INVENTION

1. Field of the Invention

The present invention relates to a toner for developing an electrostatic image. In addition, the present invention also relates to a developer, a toner container, and an image forming apparatus using the toner.

2. Discussion of the Background

Electrophotographic image forming methods have been used for various fields. Electrophotographic image forming methods typically include the following processes.

(1) charging the surface of an image bearing member such as photoreceptors (charging process):

(2) irradiating the charged image bearing member with light to form an electrostatic latent image on the image bearing member (light irradiating process);

(3) developing the electrostatic latent image with a developer including a toner to form a toner image on the image bearing member (developing process);

(4) transferring the toner image onto a receiving material (transfer process); and (5) fixing the toner image to the receiving material upon application of heat and pressure thereto (fixing process).

With respect to the fixing method, heat roller fixing methods in which a toner image on a receiving material is pressure-contacted with a heat roller to be fixed thereon are broadly used. Heat roller fixing devices typically include a heat roller and a pressure roller, and a receiving material bearing a toner image thereon is passed through the nip between the heat roller and the pressure roller to be melted, resulting in fixation of the toner image on the receiving material.

When a heat fixing method is used, the heating temperature is preferably as low as possible to save energy. However, when a binder resin having too low a thermal property (such as the melting point and the glass transition temperature) is used for a toner so that the toner can be used for such a low temperature heat fixing method, the high temperature preservability of the toner deteriorates, thereby causing a blocking problem in that the toner is blocked when preserved at a relatively high temperature. In order to impart a good combination of low temperature fixability and high temperature preservability to a toner, a polyester resin is preferably used as a binder resin of the toner. Because of having relatively low viscosity and high elasticity, polyester resins have a relatively good combination of low temperature fixability and high temperature preservability compared with vinyl resins.

Polyester resins prepared by using a bisphenol compound as a polyhydric alcohol have been broadly used as binder resins of toner. However, it is proposed to use an aliphatic or alicyclic polyhydric alcohol to prepare a polyester resin having good flexibility. This is because aliphatic or alicyclic polyhydric alcohols have molecular structures with high flexibility whereas bisphenol compounds have high rigidity.

On the other hand, in order to fix a toner image at a relatively low fixing temperature, it is important that the toner image is firmly adhered to the receiving material at a relatively low fixing temperature so as to have good rubbing resistance (i.e., good durability). In this regard, aliphatic or alicyclic polyhydric alcohols have relatively low molecular weights and therefore the number of ester groups included in the resultant polyester resins is greater than that of the ester groups included in the polyester resins prepared using bisphenol compounds. Therefore, the interaction between the toner and the hydroxyl group included in the receiving material (such as paper) can be increased, resulting in improvement of the durability of the toner image.

In attempting to impart a good combination of low temperature fixability and preservability, published unexamined Japanese patent application No. (hereinafter referred to as JP-A) 2002-091082 discloses a toner including, as a binder resin, a polyester resin obtained from a polyester component (A) which is prepared by subjecting a diol and a dicarboxylic acid to condensation polymerization and another polyester component (B) which is prepared by subjecting a branched diol (preferably an aliphatic or alicyclic diol) and a dicarboxylic acid (preferably an acid having a terephthalic structure) to condensation polymerization.

In addition, JP-A2002-055483 discloses a toner including, as a binder resin, a polyester resin which is obtained from a dicarboxylic acid component and a diol component, wherein the diol component includes a branched diol in an amount of from 20 to 90% by mole and the dicarboxylic acid component includes a carboxylic acid having a terephthalic structure in an amount of from 80 to 99.9% by mole and another carboxylic acid having an o-phthalic acid structure in an amount of from 20 to 0.1% by mole.

Further, JP-A 08-036274 discloses a toner which includes a polyester resin obtained from (a) an acid component including terephthalic acid as a main component, (b) a diol component including as a main component a linear alkylene glycol having 2 to 8 carbon atoms, and (c) a polycarboxylic acid having three or more carboxyl groups and/or a polyhydric alcohol having three or more hydroxyl groups, wherein the ratio of terephthalic acid and the linear alkylene glycol to all the monomers is not less than 50% by mole and the ratio of the component (c) to all the acid components is not greater than 3% by mole. It is described therein that the toner has relatively high hot offset temperature, wide fixable temperature range and good blocking resistance compared to conventional toners.

Japanese patent No. 3128907 (i.e., JP-A 05-165252) discloses a toner including a polyester resin which is prepared by reacting a polybasic acid component including terephthalic acid as a main component and a polyhydric alcohol component including (A) 1,4-cyclohexanedimethanol and (B) a glycol having a specific formula, wherein the molar ratio (A)/(B) is from 35/65 to 65/35, the molar ratio of total of the components (A) and (B) in the polyhydric alcohol component is not less than 90%, and the polyester resin has a glass transition temperature of from 55 to 75° C., a weight average molecular weight of from 5,000 to 20,000, a melt viscosity of from $10^4$ to $10^6$ poise, and a softening point of from 90 to 120° C. (measured by a ring and ball method). It is described therein that the toner has a good combination of fixability, blocking resistance, offset resistance and color property.

JP-A 05-100480 discloses a toner including a polyester resin which has a specific gravity of not less than 1.3 and which is obtained from a polycarboxylic acid component including terephthalic acid, isophthalic acid and a polycarboxylic acid having a sodium sulfonate group and a polyhydric alcohol component including ethylene glycol and/or its derivatives in an amount of not less than 90% by mole. It is described therein that the toner has a good combination of blocking resistance (i.e., preservability) and resistance to plasticizers included in polyvinyl chloride.

Japanese patent No. 2704282 discloses a toner including a polyester resin which is obtained by subjecting a monomer composition, which includes a monomer component having three or more functional groups, an aromatic dicarboxylic acid component, and an aliphatic dihydric alcohol component including a branched dihydric alcohol in an amount of not less than 50% by mole based on the total of the aliphatic dihydric alcohol component, to condensation polymerization. It is described therein that the toner has a good combination of fixing property, offset resistance, and releasability from fixing members.

As mentioned above, the toners including, as a binder resin, a polyester resin, which includes an aliphatic or alicyclic polyhydric alcohol component, have a good low temperature fixability. However, these toners merely have an improved thermal property and the high temperature preservability thereof is hardly improved or is rather deteriorated. In addition, these toners include an organic tin compound which is used as a catalyst and which is not friendly to the environment. Namely, it is necessary to replace such a catalyst with another catalyst such as titanium-type catalysts, bismuth-type catalysts, and inorganic tin catalysts.

Because of these reasons, a need exists for a toner having a good combination of low temperature fixability and high temperature preservability.

SUMMARY OF THE INVENTION

As one aspect of the present invention, a toner is provided which includes a core including at least a colorant, a release agent and a first binder resin, and a shell located overlying the core and including at least a second binder resin, wherein the first binder resin includes a polyester resin including a unit obtained from a diol selected from the group consisting of aliphatic diols and alicyclic dials, and the second binder resin includes a vinyl copolymer, and wherein the weight ratio (S/C) of the shell (S) to the core (C) is from 0.05 to 0.5 and the toner has a volume average particle diameter of from 3 to 8 μm. In this regard, "overlying" can include direct contact and allow for intermediate layers.

As another aspect of the present invention, a toner container is provided which includes a container containing therein the toner mentioned above.

As yet another aspect of the present invention, a developer is provided which includes the toner mentioned above and a carrier. The toner itself can be used as a one component developer.

As a further aspect of the present invention, an image forming apparatus is provided which includes at least a latent image bearing member, a developing device configured to develop the latent image with the developer mentioned above to form a toner image on the image bearing member, a transfer device configured to transfer the toner image onto a receiving material, and a fixing device configured to fix the toner image on the receiving material.

As a still further aspect of the present invention, a process cartridge is provided which includes at least a latent image bearing member, and a developing device configured to develop the latent image with the developer mentioned above to form a toner image on the image bearing member, wherein the process cartridge is detachably attached to an image forming apparatus as a unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The toner of the present invention is a toner including a core including at least a colorant, a release agent, and a first binder resin (A) and a shell including at least a second binder resin (B). The first binder resin (A) includes a polyester resin as a main component, and the second binder resin (B) includes a vinyl copolymer as a main component. The polyester resin includes a unit obtained from a diol selected from the group consisting of aliphatic diols and alicyclic diols, and the weight ratio (S/C) of the shell (S) to the core (C) is from 0.05 to 0.5. In addition, the toner has a volume average particle diameter of from 3 to 8 μm.

The toner has a good combination of low temperature fixability and charging property, and exhibits high stability to withstand environmental conditions.

Figure 1:
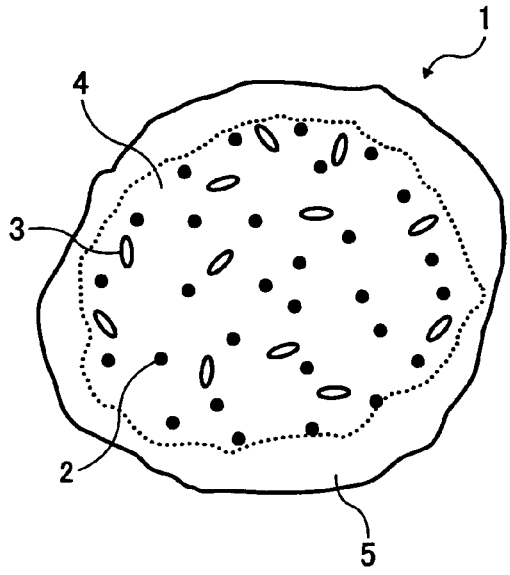
FIG. 1 is a schematic view illustrating a particle of the toner of the present invention.

FIG. 1 is a schematic view illustrating a typical toner particle of the toner of the present invention.

Referring to FIG. 1, a toner particle 1 has a core 4 including at least a first binder resin (A), a colorant 2 and a release agent 3, and a shell 5 including at least a binder resin (B). The core 4 is a main portion of the toner particle 1. The first binder resin (A) includes a polyester resin as a main component, which is used for imparting a good combination of low temperature fixability and high temperature preservability to the toner. The second binder resin (B) includes a vinyl copolymer as a main component, which is used for controlling the charging property of the toner and for imparting good high temperature preservability to the toner. By using a polyester resin including at least one unit obtained from a diol selected from the group consisting of aliphatic diols and alicyclic diols for the binder resin (A), the low temperature fixability of the toner can be further enhanced, and a good flexibility can be imparted to the toner.

The reason why the charge property of the toner can be easily controlled by using a vinyl copolymer for the shell is as follows.

(1) Plural kinds of monomers selected from monomers of various types can be used for polymerizing a vinyl copolymer (namely, the flexibility in selection of monomers is high), and thereby one or more polar groups of various types (such as carboxyl groups and sulfonic acid groups) can be incorporated in the resultant copolymer.

(2) When a copolymer is prepared by an emulsion or suspension polymerization method, it is possible to efficiently locate the desired polar groups on the surface of the resultant copolymer particles.

Therefore, the toner of the present invention is superior in fixing property, and developing property and transferring property, which is largely influenced by the charge property of the toner.

The weight ratio (S/C) of the shell (S) to the core (C) is from 0.05 to 0.5, preferably from 0.07 to 0.4, and more preferably from 0.1 to 0.3. When the weight ratio (S/C) is too small, the effect of the copolymer is hardly produced, and thereby the charge property of the toner is deteriorated. In contrast, when the weight ratio (S/C) is too large, the effect of the polyester resin in the core is hardly produced, and thereby the fixing property of the toner is deteriorated.

The toner has a volume average particle diameter of from 3 to 8 μm, and preferably from 4 to 7 μm. When the volume average particle diameter is too small, various problems such as a background development problem in that the background area of images is soiled with toner particles are caused. In contrast, when the volume average particle diameter is too large, the resolution of images deteriorates.

Next, the constituents of the toner of the present invention will be explained.

Polyester Resin

Suitable examples of the polyester resin for use in the core of the toner include polycondensation products of (1) a polyol and (2) a polycarboxylic acid. One or more of these polyester resins can be used for the polyester resin. In this regard, a polyester resin prepared by using a polyol component including at least an aliphatic or alicyclic diol is essentially included in the core as a main component.

(Polyol)

Specific examples of the polyols for use in the polyester resin include aliphatic diols such as alkylene glycols (e.g., ethylene glycol, 1,2-propylene glycol, 1,3-propylene glycol, 1,4-butane diol, and 1,6-hexanediol), and alkylene ether glycols (e.g., diethylene glycol, triethylene glycol, dipropylene glycol, polyethylene glycol, polypropylene glycol, and polytetramethylene ether glycol); alicyclic diols such as 1,4-cyclohexane dimethanol and hydrogenated bisphenol A; bisphenol compounds such as bisphenol A, bisphenol F, bisphenol S, 4,4'-dihydroxybiphenyl compounds (e.g., 3,3'-difluoro-4,4'-dihydroxybiphenyl); bis(hydroxyphenyl)alkane compounds (e.g., bis(3-fluoro-4-hydroxyphenyl)methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (i.e., tetrafluorobisphenol A), and 2,2-bis(3-hydroxyphenyl)-1,1,1,3,3,3-hexafluoropropane); bis(4-hydroxyphenyl)ether compounds (e.g., bis(3-fluoro-4-hydroxyphenyl)ether); adducts of the above-mentioned alicyclic diols with an alkylene oxide (such as ethylene oxide, propylene oxide and butylene oxide); adducts of the above-mentioned bisphenol compounds with an alkylene oxide (such as ethylene oxide, propylene oxide and butylene oxide), etc.

These polyols can be used alone or in combination.

Among these polyols, aliphatic diols such as alkylene glycols having 2 to 12 carbon atoms, and alkylene glycol adducts of alicyclic diols are preferable, and alkylene glycols having 2 to 12 carbon atoms are more preferable. By using an alkylene oxide adduct of a bisphenol compound in combination with the preferable diols, the physical properties of the resultant resin can be adjusted.

(Polycarboxylic Acid)

Specific examples of the polycarboxylic acids include alkylene dicarboxylic acids (e.g., succinic acid, and adipic acid and sebacic acid); alkenylene dicarboxylic acids (e.g., maleic acid and fumaric acid); aromatic dicarboxylic acids (e.g., phthalic acid, isophthalic acid, terephthalic acid, naphthalene dicarboxylic acid, 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, hexafluoroisopropylidenediphthalic anhydride, etc.

Among these polycarboxylic acids, alkenylene dicarboxylic acids having 4 to 20 carbon atoms, and aromatic dicarboxylic acids having 8 to 20 carbon atoms can be preferably used.

In addition, polycarboxylic acids having three or more carboxyl groups can be used. Among the polycarboxylic acids, aromatic polycarboxylic acids having 9 to 20 carbon atoms such as trimellitic acid, and pyromellitic acid can be preferably used.

Not only the above-mentioned polycarboxylic acids but also anhydrides, and lower esters (such as methyl esters, ethyl esters and isopropyl esters) thereof can also be used.

The polycarboxylic acids can be used alone or in combination.

Suitable mixing ratio of a polyol to a polycarboxylic acid (i.e., the equivalence ratio [OH]/[COOH]) of the [OH] group of a polyol to the [COOH] group of a polycarboxylic acid) is from 2/1 to 1/1, preferably from 1.5/1 to 1/1, and more preferably from 1.3/1 to 1.02/1.

The polyester resin to be included in the core of the toner of the present invention preferably has a peak molecular weight of from 1,000 to 30,000, more preferably from 1,500 to 10,000 and even more preferably from 2,000 to 8,000. When the peak molecular weight is too low, the preservability of the toner deteriorates. In contrast, when the peak molecular weight is too high, the low temperature fixability of the toner deteriorates.

Vinyl Copolymer

One or more of any known vinyl copolymers can be used as the binder resin of the shell of the toner of the present invention. The weight average molecular weight of the vinyl copolymers included in the shell is preferably not greater than 50,000, and more preferably not greater than 30,000. When the molecular weight is too high, the low temperature fixability of the toner deteriorates. The glass transition temperature of the vinyl copolymers included in the shell is preferably from 40 to 80° C., and more preferably from 50 to 70° C. When the glass transition temperature is too low, the preservability of the toner deteriorates. In contrast, when the glass transition temperature is too high, the low temperature fixability of the toner deteriorates.

The vinyl copolymers for use in the shell are prepared by copolymerizing vinyl monomers. Specific examples of the vinyl monomers include the following compounds.

(1) Vinyl Hydrocarbon Compounds

Aliphatic vinyl hydrocarbons: alkenes (e.g., ethylene, propylene, butene, isobutylene, pentene, heptene, diisobutylene, octane, dodecene, octadecene, and other olefins); and alkadienes (e.g., butadiene, isoprene, 1,4-pentadiene, 1,6-hexadiene, and 1,7-octadiene).

Alicyclic vinyl hydrocarbons: mono- or di-cycloalkenes and alkadienes (e.g., cyclohexane, (di)cyclopentadiene, vinylcyclohexene, ethylidene, and bicycloheptene); terpenes (e.g., pinene, limonene, and indene).

Aromatic vinyl hydrocarbons: styrene and its derivatives (alkyl, cycloalkyl, aralkyl, and/or alkenyl substitution) (e.g., α-methyl styrene, vinyl toluene, 2,4-dimethyl styrene, ethyl styrene, isopropyl styrene, butyl styrene, phenyl styrene, cyclohexyl styrene, benzyl styrene, crotyl benzene, divinyl benzene, divinyl toluene, divinyl xylene, trivinyl benzene; and vinyl naphthalene.

(2) Vinyl Monomers having Carboxyl Group and Salts Thereof

Unsaturated monocarboxylic acids and unsaturated dicarboxylic acids, which have a carboxyl group and have 3 to 30 carbon atoms, and anhydrides and monoalkyl(C1-C24) esters thereof (e.g., (meth)acrylic acid, maleic acid (maleic anhydride), monoalkylesters of maleic acid, fumaric acid, monoalkylesters of fumaric acid, crotonic acid, itaconic acid, monoalkylesters of itaconic acid, itaconic acid glycol monoether, citraconic acid, monoalkylesters of citraconic acid, and cinnamic acid.

(3) Vinyl Monomers having Sulfonic Acid Group and Vinyl Sulfuric Acid Monoesters, and Salts Thereof Alkene sulfonic acids having 2 to 14 carbon atoms (e.g., vinyl sulfonic acid, (meth)arylsulfonic acid, methylvinyl sulfonic acid, and styrene sulfonic acid); alkyl(C2-C24) derivatives of alkene sulfonic acids (e.g., α-methylstyrene sulfonic acid); sulfo(hydroxyl)alkyl(meth)acrylate or sulfo(hydroxyl) alkyl(meth)acrylamide (e.g., sulfopropyl(meth)acrylate, 2-hydroxy-3-(meth)acryloxypropyl sulfonic acid, 2-hydroxy-3-(meth)acryloxypropyl sulfonic acid, 2-(meth)acryloylamino-2,2-dimethylethane sulfonic acid, 2-(meth)acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl(C3-18) arylsulfosuccinic acid, sulfates of poly(n=2-30)oxyalkylene (homopolymers, and random and block copolymers of ethylene, propylene, butylene)mono(meth)acylates (e.g., sulfates of poly(n=5-15)oxypropylenemonomethacrylate), and sulfates of polyoxyethylene polycyclicphenyl ether); etc.

(4) Vinyl Monomers having Phosphoric Acid Group, and Salts Thereof

Monoesters of (meth)acryloyloxyalkylphosphoric acid (e.g., 2-hydroxyethyl(meth)acryloyl phosphate, and phenyl-2-acryloyloxyethyl phosphate), (meth)acryloyloxyalkyl(C1-C24)phosphonic acid (e.g., 2-acryloyloxyethylphosphonic acid), and salts thereof.

Specific examples of the salts of the monomers (2)-(4) include alkali metal salts (e.g., sodium and potassium salts), alkaline-earth metal salts (e.g., calcium and magnesium salts), ammonium salts, amine salts, and quaternary ammonium salts.

(5) Vinyl Monomers having Hydroxyl Group

Hydroxystyrene, N-methylol(meth)acrylamide, hydroxyethyl(meth)acrylate, hydroxypropyl(meth)acrylate, polyethyleneglycol mono(meth)acrylate, (meth)arylalcohol, crotylalcohol, isocrotylalcohol, 1-butene-3-ol, 2-butene-1-ol, 2-butene-1,4-diol, propargyl alcohol, 2-hydroxyethyl propenyl ether, sucrose aryl ether, etc.

(6) Nitrogen-Containing Vinyl Monomers

Vinyl monomers having an amino group: aminoethyl (meth)acrylate, dimethylaminoethyl(meth)acrylate, diethylaminoethyl(meth)acrylate, t-butylaminoethyl(meth)acrylate, N-aminoethyl(meth)acrylamide, (meth)arylamine, morpholinoethyl(meth)acrylate, 4-vinylpyridine, 2-vinylpyridine, crotylamine, N,N-dimethylaminostyrene, methyl-α-acetoamino acrylate, vinylimdazole, N-vinylpyrrole, N-vinythiopyrrolidone, N-arylphenylenediamine, aminocarbazole, aminothiazole, aminoindole, aminopyrrole, aminoimidazole, aminomercaptothiazole, and salts of these monomers.

Vinyl monomers having an amide group: (meth)acrylaminde, N-methyl(meth)acrylamide, N-butylacrylamide, diacetoneacrylamide, N-methylol(meth)acrylamide, N,N-methylene-bis(meth)acrylamide, cinnamic acid amide, N,N-dimethylacrylamide, N,N-dibenzylacrylamide, methacrylforlmamide, N-methyl-N-vinylacetamide, N-vinylpyrrolidone, etc.

Vinyl monomers having a nitrile group: (meth)acrylonitrile, cyanostyrene, cyanoacryalte, etc.

Vinyl monomers having a cationic quaternary ammonium group: quaternary ammonium salts (salts of methylchloride, dimethylsulfuric acid, benzylchloride, dimethylcarbonate, etc.) of vinyl monomers having a tertiary amine group (e.g., dimethylaminoethyl(meth)acrylate, diethylaminoethyl (meth)acrylate, dimethylaminoethyl(meth)acrylamide, and diethylaminoethyl(meth)acrylamide).

Vinyl monomers having a nitro group: nitrostyrene, etc.

(7) Vinyl Monomers having Epoxy Group

Glycidyl(meth)acrylate, tetrahydrofurfuryl(meth)acrylate, p-vinylphenyl phenyloxide, etc.

(8) Vinyl Esters, Vinyl(thio)Ethers, Vinyl Ketones, and Vinyl Sulfones

Vinyl esters: vinyl acetate, vinyl butyrate, vinyl propionate, diallylphthalate, diallyladipate, isopropenylacetate, vinyl methacrylate, methyl-4-vinylbenzoate, cyclohexyl methacrylate, benzyl methacrylate, phenyl (meth)acrylate, vinylmethoxy acetate, vinyl benzoate, ethyl-α-ethoxyacrylate, alkyl(C1-C50) (meth)acrylate (e.g., methyl(meth)acrylate, ethyl(meth)acrylate, propyl(meth)acrylate, butyl(meth)acrylate, 2-ethylhexyl(meth)acrylate, dodecyl(meth)acrylate, hexadecyl(meth)acrylate, heptadecyl(meth)acrylate, and eicocyl(meth)acrylate), dialkyl fumarate (each of the two alkyl groups is a linear or branched alkyl group having 2 to 8 carbon atoms or an alicyclic group), dialkyl maleate (each of the two alkyl groups is a linear or branched alkyl group having 2 to 8 carbon atoms or an alicyclic group), poly(meth)acryloxyalkanes (e.g., diaryloxyethane, triaryloxyethane, tetraaryloxyethane, tetraaryloxypropane, tetraaryloxybutane, and tetramethacryloxyethane), vinyl monomers having a polyalkylene glycol chain (e.g., polyethylene glycol (molecular weight of 300) monoacrylate, polypropylene glycol (molecular weight of 500) monoacrylate, methyl alcohol, (meth)acrylate of ethylene oxide (10 mol) adduct of methanol, and (meth)acrylate of ethylene oxide (30 mol) adduct of lauryl alcohol), poly(meth)acrylates (e.g., poly(meth)acrylates of polyhydric alcohols, such as ethylene glycol(meth) acrylate, propylene glycol di(meth)acrylate, neopentyl glycol di(meth)acrylate, trimethylol propane tri(meth)acrylate, and polyethylene glycol di(meth)acrylate), etc.

Vinyl (thio) ethers: vinyl methyl ether, vinyl ethyl ether, vinyl propyl ether, vinyl butyl ether, vinyl 2-ethylhexyl ether, vinyl phenyl ether, vinyl 2-methoxyethyl ether, methoxybutadiene, vinyl 2-butoxyethyl ether, 3,4-dihydro-1,2-pyran, 2-butoxy-2'-vinyloxydiethyl ether, vinyl 2-ethylmercaptoethyl ether, acetoxystyrene, phenoxystyrene, etc.

Vinyl ketones: vinyl methyl ketone, vinyl ethyl ketone, vinyl phenyl ketone, etc.

Vinyl sulfones: divinyl sulfide, p-vinyldiphenyl sulfide, vinylethyl sulfide, vinyl ethyl sulfone, divinyl sulfone, divinyl sulfoxide, etc.

(9) Other Vinyl Monomers

Isocyanateethyl (meth)acrylate, m-isopropenyl-α,α'-dimethylbenzyl isocyanate, etc.

(10) Fluorine-Containing Vinyl Monomers 4-fluorostyrene, 2,3,5,6-tetrafluorostyrene, pentafluorophenyl(meth)acrylate, pentafluorobenzyl(meth)acrylate, pentafluorocyclohexyl(meth)acrylate, pentafluorocyclohexylmethyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,5H-octafluoropentyl (meth)acrylate, 1H,1H,7H-dodecafluoroheptyl(meth) acrylate, perfluorooctyl(meth)acrylate, 2-perfluorooctylethyl(meth)acrylate, heptadecafluorodecyl (meth)acrylate, trihydroperfluoroundecyl(meth)acrylate, perfluoronorbornylmethyl(meth)acrylate, 1H-perfluoroisobornyl(meth)acrylate, 2-(N-butylperfluorooctanesulfonamide)ethyl(meth)acrylate, 2-(N-ethylperfluorooctanesulfonamide)ethyl(meth)acrylate, derivatives of α-fluoroacrylic acid (e.g., bishexafluoroisopropyl itaconate, bishexafluoroisopropyl maleate, bisperfluorooctyl itaconate, bisperfluorooctyl maleate, bistrifluoroethyl itaconate, and bistrifluoroethyl maleate), vinylheptafluoro butyrate, vinylperfluoro heptanoate, vinylperfluoro nanoate, vinylperfluoro octanoate, etc.

The vinyl copolymers for use in the shell of the toner of the present invention can be prepared by copolymerizing two or more of the monomers mentioned above in (1) to (10) in a desired mixing ratio. Specific examples of the vinyl copolymers include styrene-(meth)acrylate copolymers, styrene-butadiene copolymers, (meth)acrylic acid-acrylate copolymers, styrene-acrylonitrile copolymers, styrene-maleic anhydride copolymers, styrene-(meth)acrylic acid copolymers, styrene-(meth)acylic acid-divinyl benzene copolymers, styrene-styrenesulfonic acid-(meth)acrylate copolymers, etc.

When the toner is prepared, it is preferable to disperse particles of a vinyl copolymer in an aqueous medium. Such a dispersion of a vinyl copolymer can be easily prepared, for example, by an emulsion polymerization method. Specifically, it is preferable that particles of a vinyl copolymer are located on the surface of a core of the toner including at least a binder resin, a colorant and a release agent while agglomerated and/or fused with each other. By using this method, the surface of the core can be well covered with the copolymer. By fusing the particles on the surface of the core, the surface of the core can be covered better than in the case where the particles are merely agglomerated, and thereby the surface of the toner particles is smoothed. In this case, the toner has an even charge quantity distribution and good releasability.

(Modified Polyester Resin)

The binder resin (A) of the core can include a modified polyester resin (such as urethane-modified and/or urea-modified polyester resins) to adjust the viscoelasticity of the toner, i.e., to prevent occurrence of the offset problem. The added amount of such a modified polyester resin is preferably not greater than 20% by weight, more preferably not greater than 15% by weight, and even more preferably not greater than 10% by weight, based on the weight of the binder resin (A). The added amount is too large, the low temperature fixability of the toner deteriorates. Such a modified polyester resin can be mixed with other resins of the binder resin (A). However, in view of productivity, it is preferable to include a modified polyester resin in the core by the following method.

Specifically, at first a modified polyester resin (hereinafter referred to as a prepolymer) having a relatively low molecular weight and including an isocyanate group at the end thereof is prepared. The prepolymer is mixed with an amine, which can be reacted with the prepolymer, and one or more resins constituting the binder resin (A). The prepolymer is subjected to a molecular chain growth reaction and/or a crosslinking reaction in or after the granulation process (i.e., toner particle preparation process) to be a urethane- and/or urea-modified polyester resin. By using this method, the modified polyester resin having a relatively high molecular weight can be included in the core of the toner, and thereby the viscoelasticity of the toner can be easily adjusted.

(Prepolymer)

Polyester prepolymers having an isocyanate group can be prepared by reacting a polycondensation product of a polyol (1) and a polycarboxylic acid (2) (i.e., a polyester resin having a group including an active hydrogen atom) with a polyisocyanate (3). Specific examples of the group including an active hydrogen atom include hydroxyl groups (alcoholic hydroxyl group and phenolic hydroxyl group), amino groups, carboxyl groups, mercapto groups, etc. Among these groups, the alcoholic hydroxyl group is preferable. The polyol (1) preferably includes an aliphatic diol and/or an alicyclic diol.

(Polyisocyanate)

Specific examples of the polyisocyanates (PIC) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisocianates (e.g., tolylene diisocyanate and diphenylmethane diisocyanate); aromatic aliphatic diisocyanates (e.g., α,α,α',α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., the equivalence ratio [NCO]/[OH]) of the [NCO] of a polyisocyanate (PIC) to the [OH] of a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the offset resistance of the toner deteriorates.

The content of the polyisocyanate unit in the polyester prepolymer having an isocyanate group is from 0.5 to 40% by weight, preferably from 1 to 30% by weight and more preferably from 2 to 20% by weight. When the content is too low, the offset resistance of the toner deteriorates. In contrast, when the content is too high, the low temperature fixability of the toner deteriorates.

The number of the isocyanate group included in a molecule of the polyester prepolymer is generally not less than 1, preferably from 1.5 to 3, and more preferably from 1.8 to 2.5. When the number of the isocyanate group is too small, the molecular weight of the resultant urea-modified polyester (which is crosslinked and/or extended) decreases, thereby deteriorating the offset resistance of the resultant toner.

The urea-modified polyester resin for use as the binder resin of the toner of the present invention can be prepared by reacting a polyester prepolymer having an isocyanate group with an amine.

Specific examples of the amines include diamines, polyamines having three or more amino groups, amino alcohols, amino mercaptans, amino acids and blocked amines in which the amines mentioned above are blocked. These amines can be used alone or in combination.

Specific examples of the diamines include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines having three or more amino groups include diethylene triamine, triethylene tetramine, etc. Specific examples of the amino alcohols include ethanol amine, hydroxyethyl aniline, etc. Specific examples of the amino mercaptan include aminoethyl mercaptan, aminopropyl mercaptan, etc. Specific examples of the amino acids include aminopropionic acid, aminocaproic acid, etc. Specific examples of the blocked amines include ketimine compounds which are prepared by reacting one of the amines mentioned above with a ketone such as acetone, methyl ethyl ketone and methyl isobutyl ketone; oxazoline compounds, etc.

The molecular weight of the urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., the equivalence ratio [NCO]/[NHx]) of the [NCO] of the prepolymer having an isocyanate group to the [NHx] of the amine is from 1/2 to 2/1, preferably from 1/1.5 to 1.5/1 and more preferably from 1/1.2 to 1.2/1. When the mixing ratio is too low or too high, the molecular weight of the resultant urea-modified polyester decreases, resulting in deterioration of the hot offset resistance of the resultant toner.

(Colorant)

The toner for use in the image forming apparatus of the present invention includes a colorant. Suitable materials for use as the colorant include known dyes and pigments.

Specific examples of the dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

(Release Agent)

Known release agents can be used for the toner of the present invention. Known waxes can be used for the toner for use in the present invention. Specific examples of the waxes include polyolefin waxes such as polyethylene waxes and polypropylene waxes; hydrocarbons having a long chain such as paraffin waxes and SASOL waxes; and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone). Among these waxes having a carbonyl group, polyalkananoic acid esters are preferably used.

The content of the release agent in the toner is preferably from 5 to 15 parts by weight per 100 parts by weight of the resin components included in the toner. When the content is too low, good releasability cannot be imparted to the toner, thereby decreasing the margin for the offset preventing effect. In contrast, when the content is too high, the toner is easily affected by heat energy and mechanical energy, thereby causing a problem in that the release agent exudes from the surface of toner particles when the toner is agitated in a developing device and the release agent is adhered to a toner thickness controlling member and a photoreceptor, resulting in deterioration of image qualities. The release agent included in the toner of the present invention preferably has a thermal property such that an endothermic peak is observed at a temperature of from 65 to 115° C. when the release agent is subjected to differential scanning calorimetry (DSC). In this case, the toner has good low temperature fixability. When the endothermic peak temperature is too low, the fluidity of the toner deteriorates. In contrast, when the endothermic peak temperature is too high, the low temperature fixability deteriorates.

(Charge Controlling Agent)

The toner of the present invention optionally includes a charge controlling agent in the core and/or the shell thereof. In addition, a charge controlling agent may be located on the surface of the shell. It is preferable that a charge controlling agent is located in the shell or on the surface of the shell. Known charge controlling agents for use in conventional toners can be used for the toner of the present invention.

Specific examples of the charge controlling agents include Nigrosine dyes, triphenyl methane dyes, chromium-containing metal complex dyes, molybdic acid chelate pigments, Rhodamine dyes, alkoxyamines, quaternary ammonium salts, fluorine-modified quaternary ammonium salts, alkylamides, phosphor and its compounds, tungsten and its compounds, fluorine-containing activators, metal salts of salicylic acid, metal salts of salicylic acid derivatives, etc. These materials can be used alone or in combination.

Specific examples of the marketed charge controlling agents include BONTRON® 03 (Nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® (triphenylmethane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments, and polymers having a functional group such as a sulfonate group, a carboxyl group, a quaternary ammonium group, etc.

(External Additive)

A particulate inorganic material is typically mixed with toner particles to assist in improving the fluidity, developing property and charging ability of the toner particles. It is preferable for such a particulate inorganic material to have a primary particle diameter of from 5 nm to 2 μm, and more preferably from 5 nm to 500 nm. In addition, it is preferable that the specific surface area of such a particulate inorganic material measured by a BET method is from 20 to 500 $m^2/g$. The content of the external additive is preferably from 0.01 to 5% by weight, and more preferably from 0.01 to 2.0% by weight, based on the total weight of the toner.

Specific examples of such particulate inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the external additive of the toner for use in the present invention.

The external additive used for the toner is preferably subjected to a hydrophobizing treatment to prevent deterioration of the fluidity and charge properties of the resultant toner particularly under high humidity conditions. Suitable hydrophobizing agents for use in the hydrophobizing treatment include silane coupling agents, silylating agents, silane coupling agents having a fluorinated alkyl group, organic titanate coupling agents, aluminum coupling agents, silicone oils, modified silicone oils, etc.

(Cleanability Improving Agent)

The toner of the present invention optionally includes a cleanability improving agent so that toner particles remaining on the surface of a photoreceptor or an intermediate transfer medium can be easily removed therefrom. It is preferable that a cleanability improving agent is present on the surface of the shell. Specific examples of the cleanability improving agent include fatty acids and salts thereof such as stearic acid, zinc stearate, and calcium stearate; particulate polymers such as particulate polymethyl methacrylate, and particulate polystyrene, which are prepared by a soap-free emulsion polymerization method, etc. In this regard, particulate polymers having a relatively narrow particle diameter distribution and a volume average particle diameter of from 0.01 to 1 μm are preferably used.

(Toner Preparation Method)

Although the method for preparing the toner of the present invention is not particularly limited, the toner of the present invention can be preferably prepared by a method including at least a step of forming a core of the toner in which a toner composition liquid, which is prepared by dissolving or dispersing toner constituents such as a colorant, a polyester resin and a release agent in an organic solvent, is dispersed in an aqueous medium to form core particles; and a step of adding an aqueous dispersion including particles of a vinyl copolymer to the dispersion of the core particles to adhere the vinyl copolymer particles to the surface of the core particles. Specifically, the method is as follows.

(1) Preparation of Core Particles

The organic solvent for use in dissolving or dispersing the toner constituents is preferably a volatile solvent having a boiling point less than 100° C. so as to be easily removed from the resultant toner particles. Specific examples of such volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, esters such as methyl acetate and ethyl acetate, aromatic solvents such as toluene and xylene, and halogenated hydrocarbons such as methylene chloride, 1,2-dichloroethane, chloroform and carbon tetrachloride are preferably used.

The polyester resin, colorant and release agent can be dissolved or dispersed at the same time, but it is preferable that each of the materials is dissolved or dispersed in an organic solvent to prepare three solutions or dispersions and then the solutions or dispersions are then mixed. In this regard, the solvents of the three solutions or dispersions may be the same or different from the others. However, the solvents are preferably the same.

The solid content of the polyester resin solution or dispersion is preferably from 40 to 80% by weight. When the solid content is too high, the viscosity seriously increases, and therefore the solution or dispersion becomes hard to handle. In contrast, when the solid content is too low, the productivity of the toner deteriorates. When a modified polyester resin is used in combination of one or more other polyester resins, the resins are dissolved or dispersed at the same time in a solvent or each of the resins is separately dissolved or dispersed in a solvent.

The colorant is dissolved or dispersed in a solvent alone or in combination with a binder resin such as polyester resins. In this regard, a dispersant can be used. Further, a master batch of a colorant can also be used.

When a release agent such as waxes is dispersed in a poor solvent, the following methods are preferably used.

(1) One or more waxes and one or more organic solvents are mixed, and the mixture is subjected to a dispersion treatment using a dispersing machine such as bead mills; and (2) One or more wax and one or more organic solvents are mixed, and the mixture is heated to a temperature not lower than the melting point of the wax to prepare a solution. Then the solution is cooled while agitated to precipitate the wax, and the liquid is subjected to a dispersion treatment using a dispersing machine such as bead mills.

The method (2) is preferably used because the dispersing time can be shortened. In addition, when a wax dispersion is prepared, dispersants and/or resins can be used.

Suitable materials for use as the aqueous medium, in which the toner composition liquid is dispersed, include water. In addition, organic solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

The weight ratio (A/T) of the aqueous medium (A) to the toner composition liquid (T) is generally from 50/100 to 2,000/100 and preferably from 100/100 to 1,000/100. When the added amount of the aqueous medium is too low, the toner composition liquid cannot be well dispersed, and thereby toner particles (core particles) having a desired particle diameter cannot be prepared. Adding a large amount of aqueous medium is not economical.

When the toner composition liquid is dispersed in an aqueous medium, it is preferable to previously disperse an inorganic dispersant and/or a particulate resin in the aqueous medium to stabilize the toner particles (core particles) in the aqueous medium and to prepare toner particles (core particles) having a sharp particle diameter distribution.

Specific examples of the inorganic dispersants include tricalcium phosphate, calcium carbonate, titanium oxide, colloidal silica, and hydroxyapatite can be preferably used.

Suitable resins for use as the particulate resins include known resins which can form an aqueous dispersion. Specific examples of the resins include thermoplastic resins, and thermosetting resins, such as vinyl resins, polyurethane resins, epoxy resins, polyester resins, polyamide resins, polyimide resins, silicone resins, phenolic resins, melamine resins, urea resins, aniline resins, ionomer resins, polycarbonate resins, etc. These resins can be used alone or in combination. Among these resins, vinyl resins, polyurethane resins, epoxy resins, polyester resins, and mixtures thereof are preferably used.

The method for dispersing such a particulate resin in an aqueous medium is not particularly limited, and for example, the following methods (a) to (h) are used.

(a) A method in which one or more monomers are subjected to a polymerization method such as suspension polymerization, emulsion polymerization, seed polymerization and dispersion polymerization to directly prepare an aqueous dispersion of a polymer. This method is typically used for vinyl resins.

(b) A method in which one or more precursors (such as monomers and oligomers) or an organic solvent solution thereof is dispersed in an aqueous medium in the presence of a dispersant, and the dispersion is heated and/or crosslinked (in the presence of a crosslinking agent) to prepare an aqueous dispersion of a resin. This method is typically used for resins prepared by a polyaddition or polycondensation reaction (such as polyester resins, polyurethane resins, and epoxy resins).

(c) A method in which an emulsifier is dissolved in one or more precursors (such as monomers and oligomers), which are preferably a liquid, or an organic solvent solution thereof, and water is added to the mixture, followed by phase change emulsification and emulsion polymerization to prepare an aqueous dispersion of a resin. This method is typically used for resins prepared by a polyaddition or polycondensation reaction (such as polyester resins, polyurethane resins, and epoxy resins).

(d) A method in which a resin prepared by a polymerization reaction (such as addition polymerization, ring-opening polymerization, polyaddition, addition condensation and polycondensation) is pulverized by a mechanical pulverizer or a jet pulverizer, followed by classification to prepare a particulate resin, and the particulate resin is dispersed in an aqueous medium in the presence of a dispersant.

(e) A method in which a resin prepared by a polymerization reaction (such as addition polymerization, ring-opening polymerization, polyaddition, addition condensation and polycondensation) is dissolved in a solvent, and the solution is sprayed to prepare a particulate resin, and the particulate resin is dispersed in an aqueous medium in the presence of a dispersant.

(f) A method in which a resin prepared by a polymerization reaction (such as addition polymerization, ring-opening polymerization, polyaddition, addition condensation and polycondensation) is dissolved in a solvent; the solution is mixed with a poor solvent or the solution (prepared by heating) is cooled to prepare a dispersion of the resin, followed drying to prepare a particulate resin; and the particulate resin is dispersed in an aqueous medium in the presence of a dispersant.

(g) A method in which a resin prepared by a polymerization reaction (such as addition polymerization, ring-opening polymerization, polyaddition, addition condensation and polycondensation) is dissolved in a solvent, and the solution is dispersed in an aqueous medium in the presence of a dispersant, followed by heating to remove the solvent therefrom.

(h) A method in which a resin prepared by a polymerization reaction (such as addition polymerization, ring-opening polymerization, polyaddition, addition condensation and polycondensation) is dissolved in a solvent, and water is added to a mixture of the solvent and an emulsifier to perform phase change emulsification.

When a toner composition liquid is dispersed (emulsified) in an aqueous medium, a surfactant can be used if desired. Specific examples thereof include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N, N-dimethylammonium betaine.

By using a fluorine-containing surfactant as the surfactant, good effects can be produced even when the added amount is small.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl (C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20)carboxylic acids and their metal salts, perfluoroalkyl(C7-C13)carboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the cationic surfactants having a fluoroalkyl group, which can disperse a toner composition liquid in an aqueous medium, include primary, secondary and tertiary aliphatic amines having a fluoroalkyl group, aliphatic quaternary ammonium salts such as perfluoroalkyl(C6-C10) sulfoneamidepropyltrimethylammonium salts, benzalkonium salts, benzetonium chloride, pyridinium salts, imidazolinium salts, etc.

Further, it is preferable to stabilize the dispersion (emulsion) using a polymer protection colloid.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When a dispersion stabilizer, which can be dissolved in an acid or an alkali, such as calcium phosphate is used, it is preferable to add hydrochloric acid, etc. to the dispersion to dissolve the dispersion stabilizer, followed by washing to remove the dispersion stabilizer from the particles. In addition, it is possible to decompose the dispersion stabilizer using an enzyme.

Although it is acceptable that the dispersant used remains at the surface of the resultant core particles, it is preferable to wash the particles to remove the dispersant therefrom.

Known dispersing machines can be used for emulsifying the toner composition liquid in an aqueous medium. Suitable dispersing machines include low speed shearing dispersion machines, high speed shearing dispersion machines, friction dispersion machines, high pressure jet dispersion machines, ultrasonic dispersion machines, etc.

When high speed shearing dispersion machines are used, the rotation number of the rotor is not particularly limited, but the rotation number is generally from 1,000 to 30,000 rpm, and preferably from 5,000 to 20,000. The dispersion time is not particularly limited. When a batch dispersion machines are used, the dispersion time is generally from 0.1 to 5 minutes. The dispersion temperature is preferably from 0 to 150° C. (under pressure) and preferably from 20 to 80° C.

In order to remove an organic solvent from the thus prepared emulsion, a method in which the liquid is gradually heated under normal or reduced pressure to perfectly evaporate the organic solvent included therein can be used. Alternatively, a method in which the emulsion is sprayed in a dry environment to dry the organic solvent, water and dispersion included therein, resulting in formation of toner particles, can be used.

The dry environment can be formed by heating gases of air, nitrogen, carbon dioxide, combustion gas, etc., preferably, to a temperature not lower than the boiling point of the solvent having the highest boiling point among the solvents used in the emulsion. Core particles having desired properties can be rapidly prepared by performing this treatment using a spray dryer, a belt dryer, a rotary kiln, etc.

Process of Adhering Particulate Resin to Core Particles

Next, the process in which a particulate vinyl copolymer is adhered to the core particles will be explained.

In this process, at least an aqueous dispersion of a vinyl copolymer is used. Such a dispersion can be easily prepared by a known emulsion polymerization method. Such a dispersion can be used alone or in combination with a surfactant (to stabilize the vinyl copolymer and the core particles.

When a vinyl copolymer dispersion is added, the organic solvent included in the dispersion of the vinyl copolymer is or is not removed therefrom. In the latter case, the ratio of the organic solvent and the aqueous medium can be changed before adding the vinyl copolymer dispersion. In addition, a hydrophilic solvent such as alcohols can be added to the vinyl copolymer dispersion and/or the core particle dispersion.

It is preferable to add a vinyl copolymer dispersion to the core particle dispersion while agitating the core particle dispersion or applying a shearing force thereto. In addition, it is preferable to gradually add the vinyl copolymer dispersion such that the particulate vinyl copolymer is evenly adhered to the core particles. Further, it is possible to heat the mixture of the vinyl copolymer dispersion and the core particle dispersion after removal of the organic solvent, so that the adhered vinyl copolymer particles fuse. In this regard, the heating conditions (such as heating temperature and heating time) should be carefully controlled such that the resultant shell has a desired state (smoothness, etc.), and the resultant toner particles have a desired shape. In addition, it is possible to perform a two-step adhesion process in which a dispersion of a particulate material is added to the dispersion in which the vinyl copolymer particles are adhered to the core particles, followed by heating, to form a double-layer shell on the surface of the core particles. By using such a method, the surface conditions and the properties of the shell can be changed.

In the particulate material adhesion process mentioned above, the pH of the dispersions can be controlled by adding sodium hydroxide or hydrochloric acid thereto to efficiently adhere the particulate material to the core particles. In general, a metal salt serving as a coagulant is added. In this regard, the added amount of such a coagulant correlates with adhesion speed of the particulate material. However, the coagulant used is typically included in the resultant toner particles even after a washing treatment and therefore it is impossible to perfectly remove the coagulant from the toner. Therefore, when a large amount of coagulant is used, the resultant toner particles tend to include the coagulant in a large amount. In this case, the toner has drawbacks such that the toner is sensitive to change of temperature and humidity, and therefore the charge quantity of the toner changes depending on the ambient temperature and humidity. Therefore the added amount of a coagulant should be properly controlled.

Specific examples of the metal ions of the metal salts used as a coagulant include divalent metal ions such as calcium and magnesium ions, and trivalent metal ions such as aluminum ion. Specific examples of the counter anions of the metal salts include chlorine ion, bromine ion, iodine ion, carbonate ion and sulfate ion.

In the adhesion process, the dispersion mixture may be heated to accelerate adhesion of the particulate material. In this regard, the temperature may be lower or not lower than the glass transition temperature of the particulate material. However, when the adhesion process is performed at a temperature not higher than the glass transition temperature, a problem in that the particles of the particulate material are hardly agglomerated and fused. Therefore, it is preferable that in that case the dispersion is heated at a high temperature after the adhesion process to agglomerate and fuse the particulate material and to control the surface condition of the resultant shell. In this regard, the heating temperature and heating time are controlled so that the resultant shell has a desired property (smoothness, etc.), and the resultant toner particles have a desired shape.

Molecular Chain Growth Reaction and/or Crosslinking Reaction

When a modified polyester resin having an isocyanate group at the end portion thereof and an amine capable of reacting with the modified polyester are added to the toner composition liquid to include a urethane- and/or urea-modified polyester resin in the toner particles, the amine can be added to the toner composition liquid or to the aqueous medium in which the toner composition liquid is to be dispersed. The reaction time needed for reacting the modified polyester resin with the amine is determined depending on the reactivity of the isocyanate group with the amine added, but is generally from 1 minute to 40 hours, and preferably from 1 hour to 24 hours. The reaction temperature is generally from 0 to 150° C., and preferably from 20 to 98° C. This reaction can be performed before, after or in the adhering process in which the particulate material is adhered to the core particles. In addition, a catalyst can be used for the reaction.

Washing and Drying Processes

Known techniques can be used for the washing and drying processes in which the toner particles dispersed in the dispersion are washed and then dried. Specifically, at first the toner particles are separated from the liquid using a centrifugal separation machine or a filter press. The resultant toner cake is dispersed again in ion-exchange water with a temperature of from normal temperature to 40° C. After the pH of the dispersion is optionally controlled using an acid or alkali, the dispersion is subjected to a solid-liquid separation treatment. This washing operation is repeated several times to remove impurities and the surfactants included in the dispersion. The thus prepared wet toner particles are dried using a drier such as flash driers, circulation driers, reduced pressure driers, vibration driers, etc., resulting in formation of dry toner particles. In this case, the toner particle dispersion can be subjected to centrifugal treatment to remove fine particles therefrom. Alternatively, the dry toner particles are subjected to a classification treatment to remove fine particles therefrom.

Addition of External Additive

The thus prepared dry toner particles are mixed with an external additive such as particles of a charge controlling agents and/or a fluidizer. In this regard, a mechanical impact can be added thereto to fix or fuse the external additive to the surface of the toner particles. In this case, a method in which impact is applied to the mixture using a blade which is rotated at a high speed, and a method in which the mixture is fed into a high speed air flow to collide the particles against other particles and/or a collision plate. Specific examples of the impact application machines include include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Next, the image forming apparatus of the present invention will be explained.

The image forming apparatus of the present invention includes at least a rotatable image bearing member configured to bear a toner image thereon; a latent image forming device including a charger, which is configured to form an electrostatic latent image on the surface of the image bearing member; a developing device configured to develop the electrostatic latent image with a developer including the toner of the present invention to form the toner image on the image bearing member; a cleaning device configured to clean the surface of the image bearing member; a transferring device configured to transfer the toner image to a receiving material; and a fixing device configured to fix the toner image on the receiving material.

Figure 2:
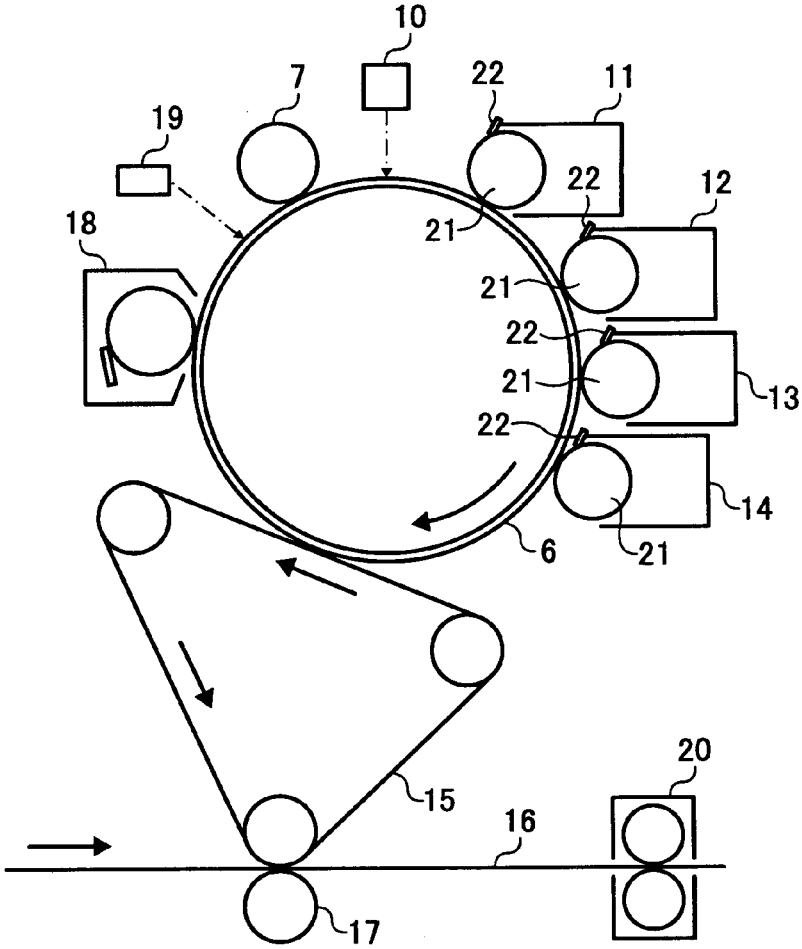
FIG. 2 is a schematic view illustrating an example of the image forming apparatus of the present invention.

FIG. 2 is a schematic view illustrating an image forming apparatus of the present invention.

The image forming apparatus includes a photoreceptor 6 serving as an image bearing member, a charging device 7 configured to charge the photoreceptor 6, a light irradiating device 10 configured to irradiate the charged photoreceptor with imagewise light to form an electrostatic latent image on the photoreceptor, four developing devices 11-14 configured to develop the electrostatic latent image with a yellow, magenta, cyan or black color toner, a cleaning device 18 configured to remove residual toner particles remaining on the photoreceptor, a discharging device 19 configured to discharge a residual charge remaining on the photoreceptor even after the toner images are transferred onto the intermediate transfer medium, an intermediate transfer medium 15 configured to receive the color toner images from the photoreceptor, and a transferring device 17 configured to transfer the toner images on the intermediate transfer medium 15 to a receiving material 16. In this regard, the charging device and the light irradiating device are sometimes referred to an image forming device configured to form an electrostatic latent image on the photoreceptor.

In the color image forming apparatus illustrated in FIG. 2, different color images (such as yellow, magenta, cyan and black color images) are formed by the four developing devices 11-14 and the color images are overlaid on the intermediate transfer medium 15. The thus overlaid color images are transferred to the receiving material 16 at the same time by the transferring device 17. The thus transferred color images are fixed with a fixing device 20, resulting in formation of a full color image. The image forming order is particularly not limited.

The developing devices 11-14 use the toner of the present invention and includes a developing roller 21 serving as a developer feeding member and a toner layer thickness controlling member 22.

The image forming apparatus is not limited thereto, and four photoreceptors can be used instead of the photoreceptor 6 for forming yellow, magenta, cyan and black color toner images thereon. In addition, the toner images on the photoreceptor can be directly transferred to the receiving material without using the intermediate transfer medium.

Figure 3:
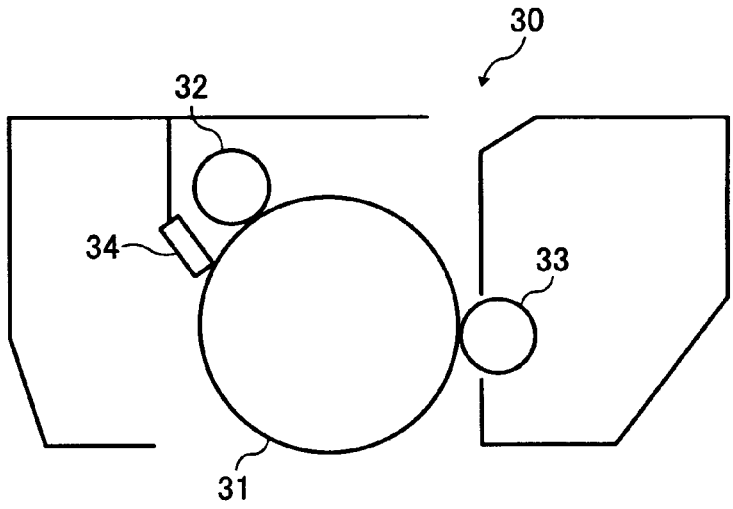
FIG. 3 is a schematic view illustrating an example of the process cartridge of the present invention.

FIG. 3 is a schematic view illustrating an example of the process cartridge of the present invention.

Referring to FIG. 3, a process cartridge 30 includes a photoreceptor 31 serving as an image bearing member; a charging device 32 configured to charge the photoreceptor 31; a developing device 33 configured to develop an electrostatic latent image formed on the photoreceptor 31 with a developer including the toner of the present invention; a cleaning device 34 configured to clean the surface of the photoreceptor 31, etc., which are integrated such that the process cartridge can be detachably attached to an image forming apparatus as a unit.

The operation of the process cartridge illustrated in FIG. 3 is as follows. The photoreceptor 31 is rotated at a predetermined peripheral speed. The rotated photoreceptor is charged by the charging device 32 so as to have a predetermined negative or positive potential. The charged photoreceptor is then exposed to imagewise light emitted by a light irradiating device (not shown) such as slit light irradiating and laser beam scanning to form an electrostatic latent image thereon. The electrostatic latent image is developed with a developing device 33 using a developer including the toner of the present invention to form a toner image on the photoreceptor 31. The thus formed toner image is transferred onto a receiving material (not shown) by a transfer device (not shown). In this regard, the receiving material is timely fed to the photoreceptor 31 so that the toner image on the photoreceptor is transferred to a predetermined position of the receiving material. The receiving material bearing the toner image thereon is separated from the photoreceptor and is fed to a fixing device so that the toner image is fixed to the receiving material. Thus, a copy or print is produced. Toner particles remaining on the surface of the photoreceptor 31 even after the transfer process are removed therefrom by a cleaning device 34. The photoreceptor 31 is then discharged by a discharger (not shown) to be ready for the next image forming operation.

Figure 4:
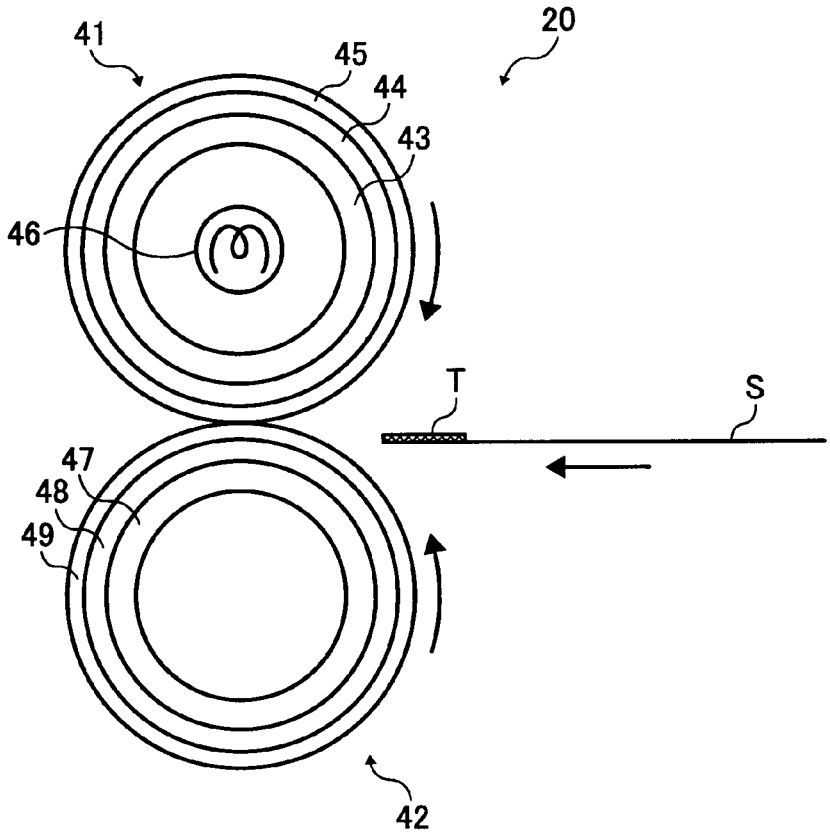
FIG. 4 is a schematic view illustrating a fixing device for use in the image forming apparatus of the present invention.

FIG. 4 is a schematic view illustrating a fixing device for use in the image forming apparatus of the present invention.

Referring to FIG. 4, the fixing device 20 includes a heat roller 41 (serving as a heating member) and a pressure roller 42, which are contacted with each other while rotating in the respective directions indicated by arrows. In this regard, the heat roller 41 and pressure roller 42 serve as a fixing member. The heat roller 41 includes an aluminum cylinder 43; an elastic layer 44 which has a thickness of 1.5 mm and which is made of a silicone rubber; and an outermost layer 45 which is made of a PFA (tetrafluoroethylene-perfluoroalkyl vinyl ether copolymer). In this fixing device, the heat roller 41 has an outside diameter of 40 mm. A heater 46 is provided inside the aluminum cylinder 43. The pressure roller 42 includes an aluminum cylinder 47; an elastic layer 48 which has a thickness of 1.5 mm and which is made of a silicone rubber; and an outermost layer 49 which is made of a PFA (tetrafluoroethylene-perfluoroalkyl vinyl ether copolymer). In this fixing device, the pressure roller 42 has an outside diameter of 40 mm.

A sheet S of a receiving material bearing a toner image T thereof is fed into the nip formed by the heat roller 41 and the pressure roller 42. The toner image receives heat and pressure at the nip to be fixed on the sheet S of the receiving material.

The structure of the process cartridge of the present invention is not limited thereto, and the process cartridge includes at least an image be a ring member and a developing device.

In the present application, the toner is analyzed and evaluated as follows. In this regard, the toner is evaluated as a one-component developer. However, the toner of the present invention can also be used for a two-component developer by being mixed with a carrier.

(Measurement Methods)

Particle Diameter of Toner

In the present application, the volume average particle diameter (Dv), number average particle diameter (Dn) and particle diameter distribution of a toner are determined by an instrument such as COULTER COUNTER TA-II and MULTISIZER II, both of which are manufactured by Beckman Coulter, Inc. The measurement method is as follows:

(1) a surfactant serving as a dispersant, preferably 0.1 to 5 ml of a 1% aqueous solution of an alkylbenzenesulfonic acid salt, is added to 100 to 150 ml of an electrolyte such as 1% aqueous solution of first class NaCl or ISOTON-II manufactured by Beckman Coulter, Inc.;

(2) 2 to 20 mg of a sample (i.e., a toner) to be measured is added into the mixture;

(3) the mixture is subjected to an ultrasonic dispersion treatment for about 1 to 3 minutes; and (4) the volume average particle diameter distribution and number average particle diameter distribution of the toner are measured using the instrument mentioned above and an aperture of 100 μm.

The volume average particle diameter and number average particle diameter of the toner can be determined from the thus obtained volume and number average particle diameter distributions.

In this case, the particle diameter channels are following 13 channels:

2.00 μm≦C1<2.52 μm; 2.52 μm≦C2<3.17 μm;

3.17 μm≦C3<4.00 μm; 4.00 μm≦C4<5.04 μm;

5.04 μm≦C5<6.35 μm; 6.35 μm≦C6<8.00 μm;

8.00 μm≦C7<10.08 μm; 10.08 μm≦C8<12.70 μm;

12.70 μm≦C9<16.00 μm; 16.00 μm≦C10<20.20 μm;

20.20 μm≦C11<25.40 μm; 25.40 μm≦C12<32.00 μm; and 32.00 μm≦C13<40.30 μm.

Thus, particles having a particle diameter not less than 2.00 μm and less than 40.30 μm are targeted.

Average Circularity of Toner

The circularity of a toner is determined by the following method:

(1) 100 to 150 ml of water, from which impurities have been removed, is mixed with 0.1 to 0.5 ml of a surfactant (alkylbenzene sulfonate), and 0.1 to 0.5 g of a sample is added thereto;

(2) the mixture is subjected to a dispersion treatment for 1 to 3 minutes using an ultrasonic dispersing machine to prepare a dispersion in which particles of the sample are present at a concentration of from 3,000 to 10,000 pieces/μl;

(3) the shape of the toner particles and the distribution of the shape is determined using a flow type particle image analyzer FPIA-2000 from Sysmex Corp., to determine the average circularity of the toner.

The circularity of a toner particle is determined by the following equation:

$$\text{Circularity}=L2/L1$$

wherein L1 represents the peripheral length of the image of a toner particle and L2 represents the peripheral length of the image of a circle having the same area as that of the image of the toner particle.

The average circularity of a toner is determined by averaging circularities of a predetermined number of toner particles.

Molecular Weight (Mw)

The molecular weight distribution of each of the resins was determined by gel permeation chromatography (GPC). The method is as follows.

1) the column (TSKgel SUPERHZM-M×3) of HLC-8220GPC from Tosoh Corp. is heated to 40° C.;

2) tetrahydrofuran (THF) is passed through the column heated to 40° C. at a flow rate of 0.35 ml/min; and 3) 0.01 ml of a 0.05-0.6% by weight tetrahydrofuran (THF) solution of a sample is injected to the column to obtain a molecular distribution curve.

The molecular weight distribution of the sample is determined using a working curve which represents the relationship between weight and GPC counts and which is previously prepared using monodisperse polystyrenes. Specific examples of the molecular weights of the monodisperse polystyrenes include $5.8\times10^2$, $2.93\times10^3$, $1.085\times10^4$, $2.85\times10^4$, $5.95\times10^4$, $1.48\times10^5$, $3.2\times10^5$, $8.417\times10^5$, $2.56\times10^6$, and $7.5\times10^6$.

Glass Transition Temperature (Tg)

In the present application, the glass transition temperature of a resin (such as polyester resins and vinyl copolymers) for use in the toner of the present invention is measured with a differential scanning calorimeter (such as DSC-6220R from Seiko Instruments Inc.). The procedure for measurements of glass transition temperature is as follows:

1) a sample is heated from room temperature to 150° C. at a temperature rising speed of 10° C./min;
2) after the sample is allowed to settle at 150° C. for 10 minutes, the sample is cooled to room temperature; and
3) after the sample is allowed to settle at room temperature for 10 minutes, the sample is heated again from room temperature to 150° C. at a temperature rising speed of 10° C./min to perform DSC measurement.

The glass transition temperature (Tg) is defined as the temperature corresponding to the midpoint of the lower and upper base lines of the DSC curve.

Particle Diameter of Particulate Material

The particle diameter of a particulate material (such as particulate vinyl copolymers) is determined using an instrument such as LA-920 from Horiba Ltd. and UPA-EX150 from Nikkiso Co., Ltd. The instrument can measure the particle diameter of a particulate material included in a dispersion.

Softening Point

The softening point of a resin and a toner is measured using a flow tester CFT-500 from Shimadzu Corp. The measuring conditions are as follows:

Weight of sample: 1.5 g
Die: diameter of 1 mm, and height of 1 mm
Pressure applied: $2.94\times10^6$ Pa (30 kgf/cm$^2$)
Temperature rising speed: 3° C./min
Pre-heating time: 180 seconds
Temperature range: 60 to 140° C.

A sample is heated under the conditions mentioned above. The softening point of the sample is defined as the temperature [T(½)] at which the half of the sample is flown out of the die.

(Evaluation Methods)

Fixing Properties

A toner is set in an image forming apparatus (IPSIO CX2500 from Ricoh Co., Ltd.) to prepare unfixed toner images in which a solid image having a width of 36 mm and a weight of 11 g/m$^2$ is located at a position 3 mm apart from the tip of an A4 size paper having a weight of 45 g/m$^2$, which is fed such that the longitudinal direction of the paper sheet is parallel to the feeding direction. In this regard, the machine direction (i.e., paper manufacturing direction) of the paper is perpendicular to the feeding direction of the paper. The paper sheets bearing the unfixed toner images are passed one by one through the fixing device illustrated in FIG. 4 while changing the temperature of the heat roller so as to be from 115 to 175° C. at intervals of 10° C., to determine the separable/non-offset temperature range of the toner in which the toner image can be well fixed without causing a non-separable problem in that the toner image is not well separated from the heat roller and an offset problem in that part of the toner image is adhered to the heat roller and the part is transferred to a portion of the receiving sheet and/or the next receiving sheet. In this regard, the fixing speed is 120 mm/sec.

The fixing properties of the toner are graded as follows.

◎: The non-separable problem and the offset problem are not caused in the temperature range of from 115 to 175° C., and the fixed images have good rubbing and scratching resistance. (excellent)

○: The non-separable problem and the offset problem are not caused in the temperature range of from 115 to 175° C., but the images fixed at relatively low fixing temperatures have slightly poor rubbing and scratching resistance.

Δ: The separable/non-offset temperature range is not narrower than 30° C. and narrower than 50° C.

X: The separable/non-offset temperature range is narrower than 30° C. (bad)

Resistance of Toner to Stress

A toner is set in an image forming apparatus (IPSIO CX2500 from Ricoh Co., Ltd.) to perform running tests in which 50 and 2000 copies of an original image having an image area proportion of 6% are continuously produced under normal temperature (23° C.) and normal humidity (45% RH) conditions. After each of the running tests, a white solid image is formed. During this image forming operation, the toner on the developing roller is sucked to determine the charge quantities ($Q_{50}$ and $Q_{2000}$) of the toner with an electrometer. The resistance of the toner to stress is graded as follows.

○: The charge quantity difference $|Q_{50}-Q_{2000}|$ is not greater than 10 μC/g. (excellent)

Δ: The charge quantity difference $|Q_{50}-Q_{2000}|$ is greater than 10 μC/g and not greater than 15 μC/g.

X: The charge quantity difference $|Q_{50}-Q_{2000}|$ is greater than 15 μC/g. (bad)

High Temperature Preservability

After a toner is preserved for 8 hours at 50° C., the toner is sieved for 2 minutes using a 42-mesh screen to determine the percentage of the toner particles remaining on the screen.

◎: The percentage is less than 10%. (excellent)

○: The percentage is not less than 10% and less than 20%.

Δ: The percentage is not less than 20% and less than 30%.

X: The percentage is not less than 30%. (bad)

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Polyester Resins

Polyester 1

The following components were contained in a reaction container equipped with a condenser, a stirrer and a nitrogen feed pipe to perform a polycondensation reaction for 8 hours at 230° C. under normal pressure.

| | |
|---|---|
| 1,2-propylene glycol | 178 parts |
| Terephthalic acid | 240 parts |
| Adipic acid | 27 parts |
| Titanium tetrabutoxide | 3 parts |

Then the reaction was further continued for 5 hours under a reduced pressure of from 10 to 15 mmHg.

Further, 24 parts of trimellitic anhydride was fed to the container to be reacted with the reaction product for 2 hours at 180° C. under normal pressure. Thus, a polyester resin 1 was prepared. It was confirmed that the polyester resin 1 has a number average molecular weight of 1,800, a weight average molecular weight of 3,400, and a glass transition temperature (Tg) of 41° C.

Polyester 2

The following components were contained in a reaction container equipped with a condenser, a stirrer and a nitrogen feed pipe to perform a polycondensation reaction for 8 hours at 230° C. under normal pressure.

| | |
|---|---|
| 1,2-propylene glycol | 89 parts |
| 1,3-butylene glycol | 105 parts |
| Terephthalic acid | 220 parts |
| Adipic acid | 45 parts |
| Titanium tetrabutoxide | 3 parts |

Then the reaction was further continued for 5 hours under a reduced pressure of from 10 to 15 mmHg.

Further, 26 parts of trimellitic anhydride was fed to the container to be reacted with the reaction product for 2 hours at 180° C. under normal pressure. Thus, a polyester resin 2 was prepared. It was confirmed that the polyester resin 2 has a number average molecular weight of 2,400, a weight average molecular weight of 4,500, and a glass transition temperature (Tg) of 48° C.

Polyester 3

The following components were contained in a reaction container equipped with a condenser, a stirrer and a nitrogen feed pipe to perform a polycondensation reaction for 8 hours at 230° C. under normal pressure.

| | |
|---|---|
| Ethylene oxide (2 mole) adduct of bisphenol A | 553 parts |
| Propylene oxide (2 mole) adduct of bisphenol A | 196 parts |
| Terephthalic acid | 220 parts |
| Adipic acid | 45 parts |
| Titanium tetrabutoxide | 3 parts |

Then the reaction was further continued for 5 hours under a reduced pressure of from 10 to 15 mmHg.

Further, 26 parts of trimellitic anhydride was fed to the container to be reacted with the reaction product for 2 hours at 180° C. under normal pressure. Thus, a polyester resin 3 was prepared. It was confirmed that the polyester resin 3 has a number average molecular weight of 2,900, a weight average molecular weight of 6,200, and a glass transition temperature (Tg) of 43° C.

Synthesis of Particulate Vinyl Copolymers

Particulate Vinyl Copolymer V-1

The following components were contained in a reaction container equipped with a condenser, a stirrer and a nitrogen feed pipe.

| | |
|---|---|
| Sodium dodecylsulfate | 1.6 parts |
| Ion-exchange water | 492 parts |

After the mixture was heated to 80° C., an aqueous solution of potassium persulfate which had been prepared by dissolving 2.5 parts of potassium persulfate in 100 parts of ion-exchange water was added to the mixture.

After 15 minutes, a mixture of the following components was dropped into the container over 90 minutes.

| | |
|---|---|
| Styrene | 152 parts |
| Butyl acrylate | 38 parts |
| Methacrylic acid | 10 parts |
| n-octylmercaptan | 3.5 parts |

The mixture was further heated for 60 minutes at 80° C., followed by cooling. Thus, a dispersion of a vinyl copolymer V-1 was prepared. It was confirmed that the solid content of the dispersion is 25% by weight, and the average particle diameter of the particulate vinyl copolymer V-1 in the dispersion is 50 nm. Further, it was confirmed that the vinyl copolymer V-1, which was prepared by drying the dispersion medium, has a number average molecular weight of 11,000, a weight average molecular weight of 18,000, and a glass transition temperature (Tg) of 65° C.

Particulate Vinyl Copolymer V-2

The following components were contained in a reaction container equipped with a condenser, a stirrer and a nitrogen feed pipe.

| | |
|---|---|
| Sodium dodecylsulfate | 1.2 parts |
| Ion-exchange water | 492 parts |

After the mixture was heated to 80° C., an aqueous solution of potassium persulfate which had been prepared by dissolving 2.5 parts of potassium persulfate in 100 parts of ion-exchange water was added to the mixture.

After 15 minutes, a mixture of the following components was dropped into the container over 90 minutes.

| | |
|---|---|
| Styrene | 150 parts |
| Butyl acrylate | 30 parts |
| Methacrylic acid | 20 parts |
| n-octylmercaptan | 3 parts |

The mixture was further heated for 60 minutes at 80° C., followed by cooling. Thus, a dispersion of a vinyl copolymer V-2 was prepared. It was confirmed that the solid content of the dispersion is 25% by weight, and the average particle diameter of the particulate vinyl copolymer V-2 in the dispersion is 80 nm. Further, it was confirmed that the vinyl copolymer V-2, which was prepared by drying the dispersion medium, has a number average molecular weight of 14,000, a weight average molecular weight of 29,000, and a glass transition temperature (Tg) of 69° C.

Synthesis of Prepolymer

The following components were contained in a reaction vessel equipped with a condenser, a stirrer and a nitrogen feed pipe and reacted for 8 hours at 230° C. under normal pressure.

| | |
|---|---|
| 1,2-propylene glycol | 366 parts |
| Terephthalic acid | 566 parts |
| Trimellitic anhydride | 44 parts |
| Titanium tetrabutoxide | 6 parts |

Then the reaction was further continued for 5 hours under a reduced pressure of from 10 to 15 mmHg. Thus, an intermediate polyester resin 1 was prepared. The intermediate polyester 1 has a number average molecular weight of 3,200, a weight average molecular weight of 12,000, a glass transition temperature (Tg) of 55° C.

In a reaction vessel equipped with a condenser, a stirrer and a nitrogen feed pipe, 420 parts of the intermediate polyester resin 1, 80 parts of isophorone diisocyanate and 500 parts of ethyl acetate were mixed and the mixture was heated at 100° C. for 5 hours to perform the reaction. Thus, a prepolymer 1 having an isocyanate group was prepared. The content of free isocyanate included in the polyester prepolymer 1 was 1.34% by weight.

Preparation of Master Batch

The following components were mixed using a HENSCHEL MIXER mixer from Mitsui Mining Co., Ltd.

| | |
|---|---|
| Water | 30 parts |
| Carbon black (REGAL 400R from Cabot Corp.) | 40 parts |
| Polyester resin (RS-801 from Sanyo Chemical Industries Ltd., acid value of 10 mgKOH/g, weight average molecular weight of 20,000 and glass transition temperature of 64° C.) | 60 parts |

The mixture, in which water penetrates the pigment, was kneaded for 45 minutes with a two roll mill whose rollers are heated to 130° C. Then the kneaded mixture was cooled by rolling, followed by pulverizing to prepare particles with a diameter of 1 mm. Thus, a master batch 1 was prepared.

Example 1

Preparation of Colorant/Wax Dispersion (Oil Phase Liquid)

In a reaction vessel equipped with a stirrer and a thermometer, 126 parts of the polyester resin 1, 42 parts of a paraffin wax having a melting point of 72° C., and 438 parts of ethyl acetate were mixed and the mixture was heated to 80° C. while agitated. After the mixture was heated at 80° C. for hours, the mixture was cooled to 30° C. over 1 hour. Then 137 parts of the master batch 1 was added thereto, and the mixture was agitated for 1 hour.

Then the mixture was contained in another container, and subjected to a dispersion treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Thus, a raw material dispersion 1 was prepared. Then 372 parts of the raw material dispersion 1 was mixed with 261 parts of a 70% ethyl acetate solution of the polyester resin 1.

The mixture was agitated with a stirrer. Thus, a colorant/wax dispersion 1 was prepared. Further, ethyl acetate was added to the colorant/wax dispersion 1 to adjust the solid content thereof so as to be 50% when the solid content was determined by drying the dispersion for 30 minute at 130° C.

Preparation of Aqueous Phase Liquid

The following components were mixed and agitated.

| | |
|---|---|
| Ion-exchange water | 838 parts |
| Aqueous dispersion of particulate resin (dispersion of a copolymer of styrene-methacrylic acid-butyl acrylate-sodium salt of sulfate of ethylene oxide adduct of methacrylic acid, solid content of 25% by weight) | 40 parts |
| Aqueous solution of sodium salt of dodecyldiphenyletherdisulfonic acid (ELEMINOL MON-7 from Sanyo Chemical Industries Ltd., solid content of 50%), | 162 parts |
| 1% aqueous solution of carboxymethyl cellulose (thickener) | 202 parts |
| Ethyl acetate | 108 parts |

Thus, a milky liquid (i.e., an aqueous phase liquid 1) was prepared.

Emulsification and Solvent Removal

Then the following components were fed into a vessel.

| | |
|---|---|
| Colorant/wax dispersion (1) prepared above | 670 parts |
| Isophorondiamine | 1.29 parts |

The components were mixed for 1 minute using a TK HOMOMIXER from Tokushu Kika Kogyo K.K. at a revolution of 5,000 rpm.

Then 101 parts of the prepolymer (1) prepared above was added thereto, and the mixture was mixed for 1 minute by the TK HOMOMIXER rotated at a revolution of 5,000 rpm. Further, 1340 parts of the aqueous phase liquid was added thereto, and the mixture was mixed for 20 minutes by the TK HOMOMIXER rotated at a revolution of from 8,000 to 13,000 rpm. Thus, an emulsion slurry 1 was prepared.

The emulsion slurry 1 was fed into a container equipped with a stirrer and a thermometer, and the slurry was heated for 8 hours at 30° C. to remove the organic solvent (ethyl acetate) therefrom. Thus, a dispersion slurry 1 was prepared.

Adhesion of Particulate Vinyl Copolymer

The thus prepared dispersion slurry 1 was mixed with 252 parts of the dispersion of the particulate vinyl copolymer V-1 prepared above, and the mixture was heated to 65° C. over 30 minutes. Then 20 parts of an aqueous solution of magnesium chloride which had been prepared by dissolving 10 parts of magnesium chloride hexahydrate in 10 parts of ion-exchange water was dropped thereinto while controlling the temperature to be 65° C. After it was confirmed that almost all the vinyl copolymer particles are adhered to the particles of the dispersion slurry 1, an aqueous solution of hydrochloric acid was added thereto to control the pH of the mixture to be 5. Then the mixture was heated to 80° C. After the mixture was heated for 2 hours at 80° C., the mixture was cooled. Thus, a dispersion slurry 1-2 was prepared.

Washing and Drying

One thousand (1,000) parts of the dispersion slurry 1-2 was filtered under a reduced pressure.

The cake was mixed with 1,000 parts of ion-exchange water and the mixture was agitated for 10 minutes with a TK HOMOMIXER rotated at a revolution of 12,000.

Then the wet cake was mixed with 1,000 parts of ion-exchange water and the mixture was agitated for 30 minutes with a TK HOMOMIXER at a revolution of 12,000 rpm while applying supersonic waves thereto, followed by filtering under a reduced pressure. This washing operation was repeated until the resultant slurry had an electric conductivity of not greater than 10 μS/cm. Thus, a wet cake (a) was prepared.

The thus prepared wet cake (a) was mixed with a 10% hydrochloric acid so that the resultant mixture has a pH of 4 and the mixture was agitated for 10 minutes with a stirrer, followed by filtering. Thus, a wet cake (b) was prepared.

Then the wet cake (b) was mixed with 1,000 parts of ion-exchange water and the mixture was agitated for 10 minutes with TK HOMOMIXER at a revolution of 12,000 rpm, followed by filtering. This washing operation was repeated until the resultant slurry had an electric conductivity of not greater than 10 μS/cm. Thus, a wet cake (1) was prepared.

The wet cake (1) was dried for 48 hours at 45° C. using a circulating air drier, followed by sieving with a screen having openings of 75 μm.

Thus, toner particles 1 were prepared. It was confirmed that the toner particles 1 have a volume average particle diameter (Dv) of 5.9 μm, a number average particle diameter (Dn) of 5.3 μm, a ratio (Dv/Dn) of 1.11, an average circularity of 0.974.

Then 100 parts of the thus prepared toner particles 1 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 1 (i.e., a developer 1) was prepared.

Example 2

Preparation of Colorant/Wax Dispersion

The following components were mixed and agitated for 2 hours with a stirrer to prepare a colorant/wax dispersion 2.

| | |
|---|---|
| Raw material dispersion prepared in Example 1 | 372 parts |
| Ethyl acetate solution of polyester resin 1 (solid content of 70%) | 242 parts |

Then ethyl acetate was added thereto so that the solid content of the colorant/wax dispersion 2 is 50% by weight when the solid content is determined by drying the dispersion for 30 minutes at 130° C.

Preparation of Aqueous Phase Liquid

The aqueous phase liquid 1 prepared in Example 1 was used.

Emulsification and Solvent Removal

Then the following components were fed into a vessel.

| | |
|---|---|
| Colorant/wax dispersion (2) prepared above | 644 parts |
| Isophorondiamine | 0.5 parts |

The components were mixed for 1 minute by a TK HOMOMIXER from Tokushu Kika Kogyo K.K. rotated at a revolution of 5,000 rpm.

Then 1340 parts of the aqueous phase liquid 1 was added thereto, and the mixture was mixed for 20 minutes by the TK HOMOMIXER rotated at a revolution of from 8,000 to 13,000 rpm. Thus, an emulsion slurry 2 was prepared.

The emulsion slurry 2 was fed into a container equipped with a stirrer and a thermometer, and the slurry was heated for 8 hours at 30° C. to remove the organic solvent (ethyl acetate) therefrom. Thus, a dispersion slurry 2 was prepared.

Adhesion of Particulate Vinyl Copolymer

The thus prepared dispersion slurry 2 was mixed with 507 parts of the dispersion of the particulate vinyl copolymer V-1 prepared above, and the mixture was heated to 65° C. over 30 minutes. Then 40 parts of an aqueous solution of magnesium chloride which had been prepared by dissolving 20 parts of magnesium chloride hexahydrate in 20 parts of ion-exchange water was dropped thereinto while controlling the temperature to be 65° C. After it was confirmed that almost all the vinyl copolymer particles are adhered to the particles of the dispersion slurry 1, an aqueous solution of hydrochloric acid was added thereto to control the pH of the mixture to be 5. Then the mixture was heated to 80° C. After the mixture was heated for 2 hours at 80° C., the mixture was cooled. Thus, a dispersion slurry 2-2 was prepared.

Washing and Drying

The procedure for the washing and drying operations in Example 1 was repeated except that the dispersion slurry 2-2 was used. Thus, toner particles 2 were prepared. It is confirmed that the toner particles 2 have a volume average particle diameter (Dv) of 5.8 μm, a number average particle diameter (Dn) of 5.2 μm, a ratio (Dv/Dn) of 1.12, an average circularity of 0.973.

Then 100 parts of the thus prepared toner particles 2 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 2 (i.e., a developer 2) was prepared.

Example 3

Preparation of Colorant/Wax Dispersion

The following components were mixed and agitated for 2 hours with a stirrer to prepare a colorant/wax dispersion 3.

| | |
|---|---|
| Raw material dispersion prepared in Example 1 | 372 parts |
| Ethyl acetate solution of polyester resin 1 (solid content of 70%) | 303 parts |

Then ethyl acetate was added thereto so that the solid content of the colorant/wax dispersion 3 is 50% by weight when the solid content is determined by drying the dispersion for 30 minutes at 130° C.

Preparation of Aqueous Phase Liquid

The aqueous phase liquid 1 prepared in Example 1 was used.

Emulsification and Solvent Removal

Then the following components were fed into a vessel.

| | |
|---|---|
| Colorant/wax dispersion (3) prepared above | 729 parts |
| Isophorondiamine | 0.5 parts |

The components were mixed for 1 minute by a TK HOMOMIXER from Tokushu Kika Kogyo K.K. rotated at a revolution of 5,000 rpm.

Then 1340 parts of the aqueous phase liquid 1 was added thereto, and the mixture was mixed for 20 minutes by the TK HOMOMIXER rotated at a revolution of from 8,000 to 13,000 rpm. Thus, an emulsion slurry 3 was prepared.

The emulsion slurry 3 was fed into a container equipped with a stirrer and a thermometer, and the slurry was heated for 8 hours at 30° C. to remove the organic solvent (ethyl acetate) therefrom. Thus, a dispersion slurry 3 was prepared.

Adhesion of Particulate Vinyl Copolymer

The thus prepared dispersion slurry 3 was mixed with 338 parts of the dispersion of the particulate vinyl copolymer V-1 prepared above, and the mixture was heated to 65° C. over 30 minutes. Then 30 parts of an aqueous solution of magnesium chloride which had been prepared by dissolving 15 parts of magnesium chloride hexahydrate in 15 parts of ion-exchange water was dropped thereinto while controlling the temperature to be 65° C. After it was confirmed that almost all the vinyl copolymer particles are adhered to the particles of the dispersion slurry 1, an aqueous solution of hydrochloric acid was added thereto to control the pH of the mixture to be 5. Then the mixture was heated to 80° C. After the mixture was heated for 2 hours at 80° C., the mixture was cooled. Thus, a dispersion slurry 3-2 was prepared.

Washing and Drying

The procedure for the washing and drying operations in Example 1 was repeated except that the dispersion slurry 3-2 was used. Thus, toner particles 3 were prepared. It is confirmed that the toner particles 3 have a volume average particle diameter (Dv) of 6.0 μm, a number average particle diameter (Dn) of 5.4 μm, a ratio (Dv/Dn) of 1.11, an average circularity of 0.972.

Then 100 parts of the thus prepared toner particles 3 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 3 (i.e., a developer 3) was prepared.

Example 4

The procedure for preparation of the toner particles 3 was repeated except that the polyester resin 1 was replaced with the polyester resin 2. Thus, toner particles 4 were prepared. It is confirmed that the toner particles 4 have a volume average particle diameter (Dv) of 5.9 μm, a number average particle diameter (Dn) of 5.3 μm, a ratio (Dv/Dn) of 1.11, an average circularity of 0.972.

Then 100 parts of the thus prepared toner particles 4 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 4 (i.e., a developer 4) was prepared.

Example 5

The procedure for preparation of the toner particles 1 was repeated except that the polyester resin 1 was replaced with the polyester resin 2. Thus, toner particles 5 were prepared. It is confirmed that the toner particles 5 have a volume average particle diameter (Dv) of 5.6 μm, a number average particle diameter (Dn) of 5.0 μm, a ratio (Dv/Dn) of 1.12, an average circularity of 0.973.

Then 100 parts of the thus prepared toner particles 5 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 5 (i.e., a developer 5) was prepared.

Example 6

The procedure for preparation of the toner particles 3 was repeated except that the dispersion of particulate vinyl copolymer V-1 was replaced with the dispersion of particulate vinyl copolymer V-2. Thus, toner particles 6 were prepared. It is confirmed that the toner particles 6 have a volume average particle diameter (Dv) of 5.9 μm, a number average particle diameter (Dn) of 5.2 μm, a ratio (Dv/Dn) of 1.13, an average circularity of 0.971.

Then 100 parts of the thus prepared toner particles 6 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 6 (i.e., a developer 6) was prepared.

Comparative Example 1

Preparation of Colorant/Wax Dispersion

The following components were mixed and agitated for 2 hours with a stirrer to prepare a colorant/wax dispersion 4.

| | |
|---|---|
| Raw material dispersion prepared in Example 1 | 372 parts |
| Ethyl acetate solution of polyester resin 1 (solid content of 70%) | 338 parts |

Then ethyl acetate was added thereto so that the solid content of the colorant/wax dispersion 4 is 50% by weight when the solid content is determined by drying the dispersion for 30 minutes at 130° C.

Preparation of Aqueous Phase Liquid

The aqueous phase liquid 1 prepared in Example 1 was used.

Emulsification and Solvent Removal

Then the following components were fed into a vessel.

| | |
|---|---|
| Colorant/wax dispersion (4) prepared above | 778 parts |
| Isophorondiamine | 1.53 parts |

The components were mixed for 1 minute by a TK HOMOMIXER from Tokushu Kika Kogyo K.K. rotated at a revolution of 5,000 rpm.

Then 1340 parts of the aqueous phase liquid 1 was added thereto, and the mixture was mixed for 20 minutes by the TK HOMOMIXER rotated at a revolution of from 8,000 to 13,000 rpm. Thus, an emulsion slurry 7 was prepared.

The emulsion slurry 7 was fed into a container equipped with a stirrer and a thermometer, and the slurry was heated for 8 hours at 30° C. to remove the organic solvent (ethyl acetate) therefrom. Thus, a dispersion slurry 7 was prepared.

Washing and Drying

The procedure for the washing and drying operations in Example 1 was repeated except that the dispersion slurry 7 was used. Thus, toner particles 7 were prepared. It is confirmed that the toner particles 7 have a volume average particle diameter (Dv) of 5.5 μm, a number average particle diameter (Dn) of 4.9 μm, a ratio (Dv/Dn) of 1.12, an average circularity of 0.975.

Then 100 parts of the thus prepared toner particles 7 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 7 (i.e., a developer 7) was prepared.

Comparative Example 2

The procedure for preparation of the toner particles 7 was repeated except that the polyester resin 1 was replaced with the polyester resin 2. Thus, toner particles 8 were prepared. It is confirmed that the toner particles 8 have a volume average particle diameter (Dv) of 5.6 μm, a number average particle diameter (Dn) of 5.0 μm, a ratio (Dv/Dn) of 1.12, an average circularity of 0.975.

Then 100 parts of the thus prepared toner particles 8 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 8 (i.e., a developer 8) was prepared.

Comparative Example 3

The procedure for preparation of the toner particles 7 was repeated except that the polyester resin 1 was replaced with the polyester resin 3. Thus, toner particles 9 were prepared. It is confirmed that the toner particles 9 have a volume average particle diameter (Dv) of 5.7 μm, a number average particle diameter (Dn) of 5.1 μm, a ratio (Dv/Dn) of 1.12, an average circularity of 0.970.

Then 100 parts of the thus prepared toner particles 9 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 9 (i.e., a developer 9) was prepared.

Comparative Example 4

The procedure for preparation of the toner particles 1 was repeated except that the polyester resin 1 was replaced with the polyester resin 3. Thus, toner particles 10 were prepared. It is confirmed that the toner particles 10 have a volume average particle diameter (Dv) of 5.8 μm, a number average particle diameter (Dn) of 5.2 μm, a ratio (Dv/Dn) of 1.12, an average circularity of 0.971.

Then 100 parts of the thus prepared toner particles 10 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 10 (i.e., a developer 10) was prepared.

Comparative Example 5

Preparation of Colorant/Wax Dispersion

The following components were mixed and agitated for 2 hours with a stirrer to prepare a colorant/wax dispersion 5.

| | |
|---|---|
| Raw material dispersion prepared in Example 1 | 372 parts |
| Ethyl acetate solution of polyester resin 1 (solid content of 70%) | 213 parts |

Then ethyl acetate was added thereto so that the solid content of the colorant/wax dispersion 5 is 50% by weight when the solid content is determined by drying the dispersion for 30 minutes at 130° C.

Preparation of Aqueous Phase Liquid

The aqueous phase liquid 1 prepared in Example 1 was used.

Emulsification and Solvent Removal

Then the following components were fed into a vessel.

| | |
|---|---|
| Colorant/wax dispersion (5) prepared above | 603 parts |
| Isophorondiamine | 0.5 parts |

The components were mixed for 1 minute by a TK HOMOMIXER from Tokushu Kika Kogyo K.K. rotated at a revolution of 5,000 rpm.

Then 1340 parts of the aqueous phase liquid 1 was added thereto, and the mixture was mixed for 20 minutes by the TK HOMOMIXER rotated at a revolution of from 8,000 to 13,000 rpm. Thus, an emulsion slurry 5 was prepared.

The emulsion slurry 5 was fed into a container equipped with a stirrer and a thermometer, and the slurry was heated for 8 hours at 30° C. to remove the organic solvent (ethyl acetate) therefrom. Thus, a dispersion slurry 5 was prepared.

Adhesion of Particulate Vinyl Copolymer

The thus prepared dispersion slurry 5 was mixed with 591 parts of the dispersion of the particulate vinyl copolymer V-1 prepared above, and the mixture was heated to 65° C. over 30 minutes. Then 70 parts of an aqueous solution of magnesium chloride which had been prepared by dissolving 35 parts of magnesium chloride hexahydrate in 35 parts of ion-exchange water was dropped thereinto while controlling the temperature to be 65° C. After it was confirmed that almost all the vinyl copolymer particles are adhered to the particles of the dispersion slurry 5, an aqueous solution of hydrochloric acid was added thereto to control the pH of the mixture to be 5. Then the mixture was heated to 80° C. After the mixture was heated for 2 hours at 80° C., the mixture was cooled. Thus, a dispersion slurry 5-2 was prepared.

Washing and Drying

The procedure for the washing and drying operations in Example 1 was repeated except that the dispersion slurry 5-2 was used. Thus, toner particles 11 were prepared. It is confirmed that the toner particles 11 have a volume average particle diameter (Dv) of 6.2 μm, a number average particle diameter (Dn) of 5.5 μm, a ratio (Dv/Dn) of 1.13, an average circularity of 0.970.

Then 100 parts of the thus prepared toner particles 11 were mixed with 0.5 parts of a hydrophobic silica having a primary particle diameter of about 30 nm and 0.5 parts of another hydrophobic silica having a primary particle diameter of about 10 nm using a HENSCHEL MIXER mixer. Thus, a toner 11 (i.e., a developer 11) was prepared.

The physical properties of the thus prepared resins are shown in Table 1, and the properties of the developers (i.e., toners) are shown in Tables 2 and 3.

TABLE 1

| | Abbreviated name | Polyol used | Weight average molecular weight (Mw) | Glass transition temperature (Tg) |
|---|---|---|---|---|
| Polyester resin 1 | P-1 | PG | 3,400 | 41° C. |
| Polyester resin 2 | P-2 | PG/BG | 4,500 | 48° C. |
| Polyester resin 3 | P-3 | BPA | 6,200 | 43° C. |
| Particulate Vinyl copolymer V-1 | V-1 | — | 18,000 | 65° C. |
| Particulate Vinyl copolymer V-2 | V-2 | — | 29,000 | 69° C. |
| Reaction product of prepolymer and amine | HP | PG | — | — |

PG: 1,2-propylene glycol
BG: 1,3-butylene glycol
BPA: ethylene oxide (2 mole) adduct of bisphenol A

TABLE 2

| | | Resin | | | Particle diameter of toner | | |
|---|---|---|---|---|---|---|---|
| | Toner | Core (C) | Shell (S) | Ratio (S/C) | Dv | Dn | Dv/Dn |
| Ex. 1 | 1 | P-1 + HP | V-1 | 0.18 | 5.9 | 5.3 | 1.11 |
| Ex. 2 | 2 | P-1 | V-1 | 0.43 | 5.8 | 5.2 | 1.12 |
| Ex. 3 | 3 | P-1 | V-1 | 0.25 | 6.0 | 5.4 | 1.11 |
| Ex. 4 | 4 | P-2 | V-1 | 0.25 | 5.9 | 5.3 | 1.11 |
| Ex. 5 | 5 | P-2 + HP | V-1 | 0.18 | 5.6 | 5.0 | 1.12 |
| Ex. 6 | 6 | P-1 | V-2 | 0.25 | 5.9 | 5.2 | 1.13 |
| Comp. Ex. 1 | 7 | P-1 + HP | — | — | 5.5 | 4.9 | 1.12 |
| Comp. Ex. 2 | 8 | P-2 + HP | — | — | 5.6 | 5.0 | 1.12 |
| Comp. Ex. 3 | 9 | P-3 + HP | — | — | 5.7 | 5.1 | 1.12 |
| Comp. Ex. 4 | 10 | P-3 + HP | V-1 | 0.18 | 5.8 | 5.2 | 1.12 |
| Comp. Ex. 5 | 11 | P-1 | V-1 | 0.54 | 6.2 | 5.5 | 1.13 |

TABLE 3

| | | | Thermal properties | | Toner property | | |
|---|---|---|---|---|---|---|---|
| | Toner | Circularity | Tg (° C.) | T½ (° C.) | Fixability | Resistance to stress | Preservability |
| Ex. 1 | 1 | 0.974 | 57 | 110 | ◎ | ○ | ◎ |
| Ex. 2 | 2 | 0.973 | 59 | 122 | ○ | ○ | ◎ |

TABLE 3-continued

| | Toner | Circularity | Thermal properties Tg (° C.) | T½ (° C.) | Toner property Fixability | Resistance to stress | Preservability |
|---|---|---|---|---|---|---|---|
| Ex. 3 | 3 | 0.972 | 55 | 117 | ◎ | ○ | ◎ |
| Ex. 4 | 4 | 0.972 | 57 | 120 | ◎ | ○ | ◎ |
| Ex. 5 | 5 | 0.973 | 59 | 118 | ◎ | ○ | ◎ |
| Ex. 6 | 6 | 0.971 | 58 | 119 | ○ | ○ | ◎ |
| Comp. Ex. 1 | 7 | 0.975 | 53 | 109 | X | X | Δ |
| Comp. Ex. 2 | 8 | 0.975 | 54 | 111 | Δ | Δ | Δ |
| Comp. Ex. 3 | 9 | 0.970 | 57 | 121 | Δ | ○ | ○ |
| Comp. Ex. 4 | 10 | 0.971 | 59 | 129 | Δ | ○ | ◎ |
| Comp. Ex. 5 | 11 | 0.970 | 59 | 128 | Δ | ○ | ◎ |

It is clear from Tables 2 and 3 that the toners of Examples 1-6, which have a core-shell structure, have good properties. In contrast, the toners of Comparative Examples 1-3 are not satisfactory in view of the fixability, resistance to stress and/or preservability. The toners of Comparative Examples 4 and 5 have a drawback in that the toner images fixed at a low temperature has low mechanical strength.

This document claims priority and contains subject matter related to Japanese Patent Application No. 2006-071935, filed on Mar. 16, 2006, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising:

a core including at least a colorant, a release agent and a first binder resin; and a shell located overlying the core and including at least a second binder resin, wherein the first binder resin includes a polyester resin including a unit obtained from a diol selected from the group consisting of aliphatic diols and alicyclic diols, and the second binder resin includes a vinyl copolymer, and wherein a weight ratio (S/C) of the shell (S) to the core (C) is from 0.05 to 0.5 and the toner has a volume average particle diameter of from 3 to 8 μm.

2. The toner according to claim 1, wherein the polyester resin has a glass transition temperature (Tg) of from 40 to 60° C.

3. The toner according to claim 1, wherein the polyester resin has a weight average molecular weight of from 3,000 to 20,000.

4. The toner according to claim 1, wherein the polyester resin does not include a unit obtained from a diol selected from the group consisting of bisphenols and derivatives of bisphenols.

5. The toner according to claim 1, wherein the first binder resin has a lower glass transition temperature than the second binder resin.

6. The toner according to claim 1, wherein the toner is prepared by a method comprising:

providing particles of the core including the first binder resin, colorant and release agent; and adhering a particulate resin to a surface of the particles of the core while agglomerating the particulate resin to form the shell.

7. The toner according to claim 1, wherein the first binder resin includes a modified polyester resin selected from the group consisting of urethane-modified polyester resins and urea-modified polyester resins.

8. The toner according to claim 1, wherein the polyester resin includes a modified polyester resin prepared by subjecting a polyester resin having an isocyanate group and an amine to at least one reaction selected from the groups consisting of molecular chain growth reactions and crosslinking reactions.

9. The toner according to claim 1, wherein the second binder resin includes an agglomerated particulate vinyl copolymer.

10. The toner according to claim 9, wherein the agglomerated particulate vinyl copolymer is fused with each other.

11. The toner according to claim 1, wherein the second binder resin has a weight average molecular weight of not greater than 50,000 and a glass transition temperature of from 40 to 80° C.

12. The toner according to claim 1, further comprising a charge controlling agent.

13. The toner according to claim 1, wherein the toner is prepared by a method comprising:

dissolving or dispersing at least a polyester resin, a colorant and a release agent in an organic solvent to prepare a toner composition liquid;

dispersing the toner composition liquid in an aqueous medium to prepare particles of the core; and adding an aqueous dispersion including a particulate vinyl copolymer and a metal salt to the particles of the core to adhere the particulate vinyl copolymer on a surface of the particles of the core.

14. A toner container containing the toner according to claim 1.

15. A developer comprising:

a carrier; and the toner according to claim 1.

16. An image forming apparatus comprising:

a latent image bearing member configured to bear an electrostatic latent image thereon;

a developing device configured to develop the latent image with a developer including the toner according to claim 1 to form a toner image on the image bearing member;

a transfer device configured to transfer the toner image onto a receiving material; and a fixing device configured to fix the toner image on the receiving material.

17. The image forming apparatus according to claim 16, wherein the fixing device includes a roller as a heating member.

18. The image forming apparatus according to claim 17, wherein an oil is not applied to the roller.

19. A process cartridge comprising:

a latent image bearing member configured to bear an electrostatic latent image thereon; and a developing device configured to develop the latent image with a developer including the toner according to claim 1 to form a toner image on the image bearing member, wherein the process cartridge is detachably attached to an image forming apparatus as a unit.

* * * * *